US010221537B2

(12) United States Patent
Tachiwada et al.

(10) Patent No.: US 10,221,537 B2
(45) Date of Patent: Mar. 5, 2019

(54) ARTIFICIAL GROUND FREEZING METHOD AND ARTIFICIAL GROUND FREEZING SYSTEM

(71) Applicant: CHEMICAL GROUTING CO., LTD., Tokyo (JP)

(72) Inventors: Yuichi Tachiwada, Chofu (JP); Tsutomu Tsuchiya, Tokyo (JP); Takeru Ariizumi, Kanagawa (JP); Hiroshi Soma, Kanagawa (JP)

(73) Assignee: CHEMICAL GROUTING CO., LTD., Tokyo (JP)

( * ) Notice: Subject to any disclaimer, the term of this patent is extended or adjusted under 35 U.S.C. 154(b) by 0 days.

(21) Appl. No.: 15/537,020

(22) PCT Filed: Apr. 22, 2015

(86) PCT No.: PCT/JP2015/062198
§ 371 (c)(1),
(2) Date: Jun. 16, 2017

(87) PCT Pub. No.: WO2016/098367
PCT Pub. Date: Jun. 23, 2016

(65) Prior Publication Data

US 2017/0350087 A1 Dec. 7, 2017

(30) Foreign Application Priority Data

Dec. 19, 2014 (JP) ..... 2014-257216

(51) Int. Cl.
*E02D 3/11* (2006.01)
*B02C 1/06* (2006.01)
(Continued)

(52) U.S. Cl.
CPC ..... *E02D 3/115* (2013.01); *E02D 19/14* (2013.01); *E21D 1/12* (2013.01); *E21D 9/04* (2013.01)

(58) Field of Classification Search
CPC ..... E02D 3/11; E02D 3/115; E02D 19/14; B09C 1/06
(Continued)

(56) References Cited

U.S. PATENT DOCUMENTS 3,559,737 A * 2/1971 Ralstin ..... B65G 5/005 166/271
3,648,767 A * 3/1972 Balch ..... F28D 15/00 165/104.19
(Continued)

FOREIGN PATENT DOCUMENTS

DE 954048 C 12/1956
GB 516211 A 12/1939
(Continued)

OTHER PUBLICATIONS

International Search Report for International Application No. PCT/JP2015/062198 dated Jun. 16, 2015.
(Continued)

*Primary Examiner* — Benjamin F Fiorello
*Assistant Examiner* — Edwin J Toledo-Duran
(74) *Attorney, Agent, or Firm* — Kratz, Quintos & Hanson, LLP

(57) ABSTRACT

The purpose of the present invention is to provide an artificial ground freezing method having good coolant thermal efficiency without a gas-phase coolant being released into the ground or into the air. For that purpose, the present invention has: a freeze pipe (1: casing) for freezing the ground buried in the ground and a coolant circulation pipe (2) provided on the inside of the freeze pipe (1), wherein the
(Continued)

coolant flowing inside the coolant circulation pipe (2) is carbon dioxide; and a coolant apparatus (10) that cools and supplies the carbon dioxide to the coolant circulation pipe (2), the coolant circulation pipe (2) comprising a first coolant circulation pipe (2A) on which a plurality of micro-coolant passages (2A delta) is formed, wherein the tip portion (tip portion in the ground) of the first coolant circulation pipe (2A) is connected to a plugging member (3: bottom socket) that connects the plurality of micro-coolant passages (2A delta) of the first coolant circulation pipe (2A) to a coolant supply side and coolant return side.

32 Claims, 15 Drawing Sheets

(51) Int. Cl.

| | |
|---|---|
| ***E02D 19/14*** | (2006.01) |
| ***E02D 3/115*** | (2006.01) |
| ***E21D 1/12*** | (2006.01) |
| ***E21D 9/04*** | (2006.01) |

(58) Field of Classification Search
USPC ..... 405/130, 131; 165/45–66, 14 S; 62/439, 62/530; 126/436, 400, 430; 219/325; 175/17–18; 299/3–6
See application file for complete search history.

(56) References Cited

U.S. PATENT DOCUMENTS 3,835,239 A * 9/1974 Schmidt ..... H01R 4/68 174/15.3
4,240,268 A * 12/1980 Yuan ..... F24F 5/0046 126/400
4,250,958 A * 2/1981 Wasserman ..... F28D 20/02 126/618
5,034,235 A * 7/1991 Dunn ..... A23L 3/26 422/24
5,207,075 A * 5/1993 Gundlach ..... F24F 5/0017 237/2 B
5,584,190 A * 12/1996 Cole ..... F25B 6/04 165/45
2003/0080604 A1* 5/2003 Vinegar ..... E21B 43/243 299/14
2003/0121644 A1* 7/2003 Tonosaki ..... H01L 23/473 165/104.25
2003/0193989 A1* 10/2003 Tsang ..... G01N 25/04 374/16
2004/0086757 A1* 5/2004 Mohapatra ..... C09K 5/10 429/437
2004/0120772 A1* 6/2004 Vinegar ..... B09C 1/00 405/128.85
2005/0034477 A1* 2/2005 Hu ..... B64D 13/00 62/435
2009/0211727 A1* 8/2009 Yin ..... F24F 5/0046 165/45
2010/0200466 A1* 8/2010 Dana ..... C10G 1/02 208/390
2011/0298270 A1* 12/2011 Duyvesteyn ..... C22B 3/02 299/5
2017/0138010 A1* 5/2017 Schmand ..... E02D 3/115

FOREIGN PATENT DOCUMENTS

JP 06136738 A * 5/1994
JP H6-147697 A 5/1994
JP H6-173242 A 6/1994
JP H11-209990 A 8/1999
JP 3241872 B2 12/2001
JP 2003-239270 A1 8/2003
JP 2003239270 A * 8/2003
JP 2005-23614 A1 1/2005
JP 2006-38277 A 2/2006
JP 2006241905 A * 9/2006
JP 2010-145021 A 7/2010

OTHER PUBLICATIONS

Extended European Search Report for European Application No. 15869576.7 dated Jul. 13, 2018 (8 pages).

* cited by examiner (1)

(2)

(3)

ARTIFICIAL GROUND FREEZING METHOD AND ARTIFICIAL GROUND FREEZING SYSTEM

TECHNICAL FIELD

The present invention relates to an artificial ground freezing technology.

BACKGROUND ART

Artificial ground freezing methods have been used for ground improvement work using tunnel boring machine (TBM) for the launch area and the arrival are of TBM shafts, cross passage between tunnels, connection in underground tunnels, and enlargement of TBM tunnel (space). For artificial ground freezing methods applying to such objects, since larger and deeper underground structures are required and therefore extremely large scale of freezing is required, it is necessary to maintain ground freezing work in several months or even several years.

As conventionally known, strength of frozen ground depends on the freezing temperature with negative correlation, that is, the strength increases as the temperature descends. Since water cutoff and pressure-proof properties are desired in said frozen ground, it is necessary to maintain a freezing temperature equal to or less than −10° C. in a predetermined mass of ground (with the size determined by thickness, width, and height) for long periods in order to ensure design strengths.

In a typical artificial ground freezing method, basically, there are steps for placing freeze pipes in the ground, circulating a low-temperature coolant in the freeze pipes, cooling the ground around the pipes, and freezing the ground. In cases that tunnels are connected in underground, it is possible to freeze ground around the tunnel boring machine or tunnel linings by providing freeze pipes inside of steel shells of tunnel boring machines or tunnel lining or by placing freeze pipes on said steel shells or tunnel lining.

In methods of cooling freeze pipes, there are two types, that is, brine type and low-temperature liquefied gas type. In the brine type, antifreeze (brine) such as aqueous solution of calcium chloride is cooled at approximate −30° C. by a freezing device provided on the ground, the antifreeze is circulated in the freeze pipes and then cools the ground. On the other hand, in the low-temperature liquefied gas type, liquid-phase nitrogen having been transported by a tank lorry is supplied to the freeze pipes directly in order to cool the ground, the ground is frozen by vaporization heat of the nitrogen and vaporized nitrogen gas is diffused in the atmosphere. Normally, the low-temperature liquefied gas type is applied in short-term and small-scale underground construction work, a frozen soil typical quantity of which is equal to or less than 200 $m^3$, or in soil sampling surveys.

An artificial ground freezing method in which brine is used is primarily applied in the underground tunnel construction, etc., said method with brine is shown in FIG. 16 with a refrigerator.

Specifically, in FIG. 16, a secondary coolant (brine) is cooled by an evaporator 100A of a refrigerator 100, said the temperature of the secondary coolant rises while flowing in freeze pipes 101 positioned in a ground G (two pipes in FIG. 16) in order to freeze the ground around the pipes.

In a system shown in FIG. 16, a primary coolant (Coolant R404a, etc.) of the refrigerator 100 is vaporized by the heat exchanged with the secondary coolant, and then, the vaporized primary coolant is liquefied by the heat exchanged with water in a condenser 100B. The heat transferred from the primary coolant to water in the condenser 100B is diffused by a cooling tower 100C.

Furthermore, the numeral 102 refers to a coolant circulation pump.

In a prior art brine method shown in FIG. 16, brine is cooled at approximate −30° C. by a freezing device (refrigerator) installed on the ground. In a case that artificial ground freezing method is applied for ground improvement work using tunnel boring machines in the launch areas and the arrival areas of TBM shaft, connecting passage between underground tunnels or underground tunnel connecting areas, there is a problem that large quantity of energy is necessary in order to cool a large amount of brine in low temperature, if a scale of ground size to be frozen is extremely large.

Also, since brine is a highly viscous fluid with the coefficient of viscosity approximate ten times as large as the coefficient of viscosity of water, a diameter of freeze pipes must be large, and also, the brine must circulate in the freeze pipes with high flow rate in order to efficiently absorb heat from the ground to be frozen. For these requirements, freeze pipes with a large diameter are necessary, and therefore, higher expenses for boring and pipe materials are required. Furthermore, higher capacity in brine circulation pump being required leading to higher rental cost of brine circulation pump and larger pump driving energy, and therefore, economically disadvantage generates.

A freeze pipe used in a prior art brine method is mainly a double-pipe structure comprising an outer pipe in which supply-brine flows from a freezing device and an inner pipe in which brine absorbing underground heat flows. Such a freeze pipe may be a steel pipe, e.g., a gas pipe, which must extend and is buried in the ground from a few meters to 100 meters in the vertical direction. Upon production at a plant, steel pipes, each cut into a fixed length of 5.5 m, are transported to a construction site by truck, then, welded above a borehole, at the construction site, and inserted into underground area as freeze pipes.

In a case that a diameter of freeze pipe is large, there is a problem that truck transportation cost and rental cost of a crane for pipe lifting are expensive, large effort for welding is required, and therefore, economically disadvantage is generated. Also, there are other economic problems that a time periods of steps for boring and for placing freeze pipes of underground construction become longer respectively and the entire construction costs are extremely expensive.

Also, if underground brine leakage from defective welded freeze pipes generates, the ground around the leakage position fails to sufficiently freeze, water leakage is generated and insufficient ground strength will not be accomplished, and therefore, it is difficult to carry out subsequent construction work.

On the other hand, in a prior art low-temperature liquefied gas type, liquefied carbon dioxide is injected into the ground and freezes the soil around pipes by heat of vaporization of the liquefied carbon dioxide (Patent Document 1), and in a case said prior art type is applied to ground improvement work using tunnel boring machine in the launch areas and the arrival areas of TBM shaft, connecting passage between underground tunnels or underground tunnel connecting areas, a large amount of liquefied carbon dioxide is necessary to maintain a state that a soil is frozen for long periods.

Here, when the neighboring ground to the injection point of liquefied carbon dioxide starts to be frozen, since it is difficult to deliver liquefied carbon dioxide behind the frozen ground, there is a problem that it is impossible to form frozen soil with a temperature being equal to or less than −10° C.

In a prior art method in which a double-pipe structure is used and ground is frozen by utilizing liquid-phase nitrogen with an extremely low boiling point (Patent Document 2), since nitrogen gas is eventually released as "waste" into the atmosphere, there is an economically disadvantage in a case that a scale of the method being carried out is large and consumption quantity of nitrogen gas is large. In addition, an oxygen concentration at a construction site is descended, when large quantity of nitrogen is discharged into the ground or the atmosphere.

CITATION LIST

Patent Literature

Patent Literature 1: Japanese Patent Application Non-examined Publication Gazette No. 2003-239270 (JPA2003-239270)

Patent Literature 2: Japanese Patent Application Non-examined Publication Gazette No. 2005-23614 (JPA2005-23614)

SUMMARY OF INVENTION

Problem to be Solved by the Invention

The present invention is provided in view of the problems of the above-mentioned prior arts, a purpose thereof is to provide an artificial ground freezing method and an artificial ground freezing system actualizing an excellent thermal efficiency of coolant without releasing any gas-phase coolant into the ground or into the atmosphere.

Means for Solving the Problem

The artificial ground freezing system of the present invention is characterized in that;

a coolant circulating in the circulation pipe (2) of the system is carbon dioxide and a coolant apparatus (10) for cooling the coolant and supplying the coolant to a coolant circulation pipe (2) is provided;

the coolant circulation pipe (2) includes a first coolant circulation pipe (2A, 3C: micro channel) (including both of an overall flat pipe and a non-flat pipe) having a plurality of micro-coolant passages (2Aδ) formed inside of the first coolant circulation pipe; and that a tip portion (underground-side end) of the first coolant circulation pipe (2A, 2A1, 3C: micro channel) is connected with a plugging member (3: bottom socket: socket for connecting coolant paths) for communicating the plurality of micro-coolant passages (2Aδ) of the first coolant circulation pipe (2A, 2A1, 3C: micro channel) into a coolant supply side and a coolant return side.

In the present invention, said coolant circulation pipe (2, 2A, 2A1, 3C: micro channel) can be formed of a circle cross-section or other cross-sections, for instance the coolant circulation pipe has a flat shape cross-section, or can be constructed by a hollow tube.

Here, the first coolant circulation pipe (2A, 3C: micro channel) having a plurality of micro-coolant passages (2Aδ) formed inside thereof is preferably made of aluminum, which is excellent in aspects of lightness and thermal properties of cold energy diffusion and hot energy absorption. Likewise, said plugging member (3) and the connecting member (4) written hereinafter are preferably made of the same metal (aluminum) as said first coolant circulation pipe (2A, 2A1, 3C: micro channel). The material without aluminum may be applied, that is, copper, aluminum alloy, and copper alloy may be applied. In other words, in the present invention, there are no specific restrictions relating to materials.

Also, the phrase "freeze pipe" is written so as to include a casing of an excavator and other tubular members in meaning thereof.

The phrase "socket" used in this specification is written so as to mean a member engaging one member to be connected with another member, or a member which engages with one member in order to join and extend a flow path.

Preferably, in the present invention, the artificial ground freezing system includes a freeze pipe (1: e.g., casing) being buried in ground in order to freeze the ground and a coolant circulation pipe (2) being provided inside of the freeze pipe (1).

It is preferable that one or a plurality of coolant circulation pipes (2) be inserted into said freeze pipe (1).

In the artificial ground freezing system of the present invention, it is preferable that an end on the coolant supply side (end on the ground in the embodiments shown in the drawings) of the first coolant circulation pipe (2A: micro channel) is connected with a connecting member (4: top socket: socket for branching, assembling and connecting) for dividing the plurality of micro-coolant passages (2Aδ) of the first coolant circulation pipe (2A, 3C: micro channel) into the coolant supply side and the coolant return side, and that the coolant supply side and the coolant return side of the plurality of micro-coolant passages (2Aδ) of the first coolant circulation pipe (2A: micro channel) are connected with second coolant circulation pipes (2B: coolant circulation pipes with a circular cross-section) through the connecting member (4: top socket).

Here, the connecting member (4: top socket) may be provided in ground (G) (FIGS. 3 to 5), or provided at a position being closer to the coolant supply side than the ground (G) (FIGS. 6 to 8).

The phrase "dividing (divide)" written in the above phrase "for dividing the plurality of micro-coolant passages (2Aδ) into the coolant supply side and the coolant return side" has two meanings, one of which means that micro-coolant passages on a coolant supply side and a coolant return side are fixed, and the other of which means that micro-coolant passages on a coolant supply side and a coolant return side may be changed.

Also, in the artificial ground freezing system of the present invention, it is preferable that a heat transfer fluid (5: containing water) is filled in a region of the ground to be frozen, and an insulator (6) is provided in a region of the ground not to be frozen.

Preferably, in a case that said insulator (6) is a fluid, a packer (7) for dividing the two regions in fluid-tight manner is provided on the border between the region corresponding to the ground to be frozen and the region corresponding to the ground not to be frozen. The packer (7) is preferably made of an insulator.

Further, in the artificial ground freezing system of the present invention, a plurality of first coolant circulation pipes (2A: micro channel) are provided in the freeze pipe (1: casing), and a spacer (8), which maintains the space between the first coolant circulation pipes (2A) and the inner surface of the freeze pipe (1) and the space between the plurality of first coolant circulation pipes (2A), is preferably provided in the freeze pipe (1).

The artificial ground freezing method of the present invention is characterized in that an artificial ground freezing system is applied which includes a coolant apparatus (10) for cooling and supplying the coolant to a freeze pipe (1) and a coolant circulating in the coolant circulation pipe (2) being carbon dioxide;

Liquid-phase carbon dioxide circulates in the coolant circulation pipe (2) comprising a first coolant circulation pipe (2A, 2A1, 3C: micro channel) having a plurality of micro-coolant passages (2Aδ) formed inside of the first coolant circulation pipe; and that carbon dioxide being supplied from the coolant apparatus (10) on a coolant supply side circulates in some portions of the plurality of micro-coolant passages (2Aδ) of the first coolant circulation pipe (2A, 2A1, 3C: micro channel) having the tip portion (underground end) to which a plugging member (3: bottom socket) is connected, and carbon dioxide flowing toward the coolant supply side circulates in the other portions of the plurality of micro-coolant passages (2Aδ) on a coolant return side.

In the artificial ground freezing method of the present invention, said artificial ground freezing system preferably includes a freeze pipe (1: casing), which is buried in the ground in order to freeze the ground, and a coolant circulation pipe (2) is provided inside of the freeze pipe (1).

Also, it is preferable that one or a plurality of coolant circulation pipes (2) are inserted into said freeze pipe (1).

In the artificial ground freezing method of the present invention, it is preferable that an end of the coolant supply side of the first coolant circulation pipe (2A, 2A1, 3C: micro channel) is connected with a connecting member (4: top socket), and carbon dioxide flowing on the coolant supply side of the plurality of micro-coolant passages (2Aδ) of the first coolant circulation pipe (2A, 2A1, 3C: micro channel) and carbon dioxide flowing on the coolant return side flow on a coolant supply side and a coolant return side of second coolant circulation pipes (2B: coolant circulation pipes having a circular cross-section), respectively, through the connecting member (4: top socket).

As mentioned above, the connecting member (4: top socket) may be provided in the ground (G) (FIGS. 3 to 5), or provided in an area being closer to the coolant supply side than the ground (G) (FIGS. 6 to 8).

Also, the artificial ground freezing method of the present invention preferably comprises:

a step for filling a heat transfer fluid (5) in a region of the ground to be frozen; and a step for providing an insulator (6) in a region of the ground not to be frozen.

Herein, in a case that said insulator (6) is in a form of liquid-phase, it is preferable that the insulator fluid (6) is filled in said step for providing the insulator (6) and that a packer (7), which is provided on the border between a region of the ground to be frozen and a region of the ground not to be frozen is expanded, prior to filling insulator fluid, in order to divide the region to be frozen and the region not to be frozen in fluid-tight manner.

Further, in the artificial ground freezing method of the present invention, in a case that a plurality of first coolant circulation pipes (2A, 2A1: micro channel) are provided in the freeze pipe (1: casing), the plurality of first coolant circulation pipes (2A, 2A1: micro channel) are provided through an opening (8M) of a spacer (8) being provided in the freeze pipe (1), and that a space between the first coolant circulation pipes (2A, 2A1) and the inner surface of the freeze pipe (1) and a space between the plurality of first coolant circulation pipes (2A, 2A1) are maintained within certain distances, respectively.

Additionally, it is preferable that in the artificial ground freezing method of the present invention, the first coolant circulation pipe (2A, 2A1: micro channel) is manufactured in a form of flat roll, and that said flat roll is unrolled and the first coolant circulation pipe is inserted into the freeze pipe (1).

In a case that the second coolant circulation pipe (2B: coolant circulation pipe with a circular cross-section) is provided, it is preferable that the pipe is connected by a joint member (screw-type pipe joint, etc.).

Advantageous Effects of the Invention

According to the present invention having the above-mentioned constructions, the secondary coolant is liquid-phase carbon dioxide, and the liquid-phase carbon dioxide being supplied from the coolant apparatus absorbs underground heat, and then, carbon dioxide is vaporized and freezes the ground by applying latent heat of vaporization. Accordingly, this coolant is better in an aspect of thermal efficiency than brine coolant being used in a prior art which utilizes sensible heat of the brine coolant.

In the present invention, since liquid-phase carbon dioxide circulates as a coolant in a circulating system (closed system) comprising coolant circulation pipes (2) and a coolant circulation pump (11), carbon dioxide gas is not released into the atmosphere, not as like as the prior art method in which liquefied gas is circulates as a coolant. Therefore, cooled carbon dioxide gas is not wasted, costs for cooling and condensing coolant gas can be reduced, in comparison with a prior art method in which a liquefied gas is used as a coolant.

Additionally, since it is not necessary to release carbon dioxide gas into the ground or into the atmosphere, the oxygen concentration can be maintained at an allowable level in a construction site, and therefore, a situation that a construction worker has to work in an oxygen-deficient environment can be prevented.

Since the coefficient of viscosity of liquid-phase carbon dioxide as a coolant is extremely small, that is, approximately 1/90 times the coefficient of viscosity of brine, it is possible to reduce a cross-section area of a circulation pipe in which a secondary coolant circulates and increase a speed for circulating the secondary coolant. In addition, in a case that liquid-phase carbon dioxide is circulated as a secondary coolant, since the coolant is vaporized by underground heat in the ground, a liquid-phase coolant and a gas-phase coolant are mixed in a coolant circulation pipe (2), and then, the viscosity is reduced.

Therefore, in the artificial ground freezing system of the present invention, a diameter of the freeze pipe can be reduced, it is possible to make longer a length of the coolant circulation pipe (2), and the capacity of a coolant circulation pump (11) can be reduced. Therefore, a hire of machine and pump driving energy can be reduced.

In a prior art brine method, it is necessary to hang double pipe, which is a freeze pipe, and to weld repeatedly the double pipe in a fixed length of 5.5 m. Against to them, the flat shaped coolant circulation pipe (2A, 2A1: micro channel) being used in the present invention is excellent in flexibility, it can be manufactured in plant in a situation that it is rolled and a plugging member (3) and a connecting member (4) are brazed, it can be transported to a construction site, and it can be expanded linearly from a rolled condition and can be inserted into a borehole. This process requires no welding of pipes at fixed length, and therefore, it is possible to significantly reduce construction costs. Also, leakage of a secondary coolant from welded pipes can be prevented.

For the first coolant circulation pipes (3C: micro channels) being formed as a hollow tube, these of a certain length can be also connected each other easily in a manner that leakage of a coolant can be prevented assuredly.

Additionally, since the second coolant circulation pipes (2B) with a circular cross-section are small in diameter, it is possible to connect easily and assuredly the second coolant circulation pipes each other by means of the joint member which is a screw-type pipe joint to fasten the pipes. Likewise, the second coolant circulation pipes (2B) with a circular cross-section and the connecting member (4: top socket) can be connected easily and assuredly by means of a screw pipe-type joint (etc.).

In a case that forming a frozen wall for a short period of time is desired, it is effective to reduce the interval between freeze pipes (1) in view of thermal conductive properties of cold energy in the ground.

In a prior art brine method, as mentioned above, since double pipes must be welded repeatedly in fixed length and much work for installing freeze pipes is necessary, such the pipes are installed with an interval of 0.8 to 1.0 m. On the other hand, the coolant circulation pipes (2: micro channel and/or pipe with a circular cross-section) being used in the present invention, as mentioned above, it is not necessary to weld the coolant circulation pipes at each of a certain length and work for installing one freeze pipe is small. Also, since it is possible to make diameter of a freeze pipe (1) small, construction efficiency can be improved and a construction period can be shortened. Accordingly, by the present invention, the horizontal interval between freeze pipes (1) can be shorter than the corresponding interval in a prior art brine method, it is possible to change the freezing from a single pipe freezing to the wall freezing with plural pipes set in line, and therefore, said frozen wall can be formed in a short construction period.

In addition, according to the present invention, it is possible to freeze a region of ground extending in a direction not only a vertical direction but also horizontal direction and a direction extending aslant to the vertical direction.

Also, it is possible to freeze not only a region extending from the ground surface down to the vertical direction, but also a region extending upward in the vertical direction in the ground.

DESCRIPTION OF EMBODIMENTS

Embodiments of the present invention will be described with reference to the accompanying drawings.

Figure 1:
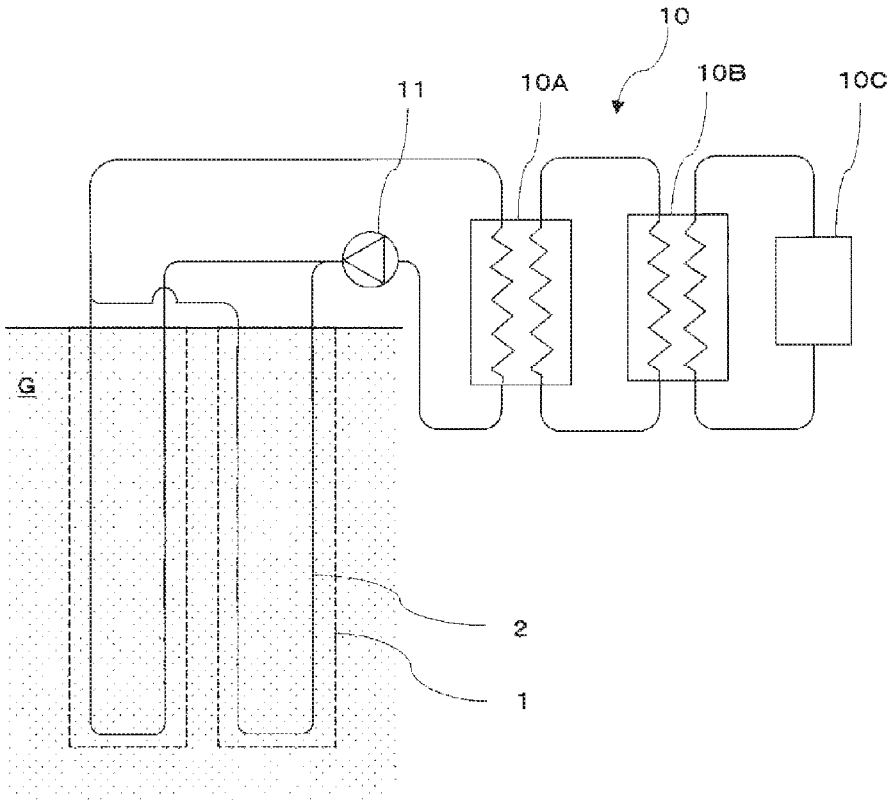
FIG. 1 is a block diagram showing an abstract of an artificial ground freezing method according to one of the embodiments of the present invention.

FIG. 1 shows an outline of a heat exchange cycle according to the first embodiment and the second embodiment shown in the drawings.

In FIG. 1, a plurality of freeze pipes 1 (casing) for freezing a ground G are buried in the ground (2 pipes in FIG. 1), and the freeze pipes 1 (casing) are provided with coolant circulation pipes 2 in parallel. A secondary coolant which circulates in the coolant circulation pipes 2 is carbon dioxide ($CO_2$), said liquid-phase carbon dioxide being supplied from a part above the ground performs heat exchange with the ground G, and said liquid-phase carbon dioxide freezes the ground G by sensible heat or latent heat of vaporization thereof.

The artificial ground freezing system shown in FIG. 1 includes a coolant apparatus 10 and a coolant circulation pump 11, said coolant apparatus 10 cools the liquid-phase carbon dioxide and supplies it to the freeze pipe 1. The coolant apparatus 10 includes a liquefier 10A (carbon dioxide liquefier), a condenser 10B, and a cooling tower 10C.

In the liquefier 10A, carbon dioxide, which has been subjected heat exchange with the ground G while circulating in the coolant circulation pipes 2, is subjected to heat exchange with a primary coolant, and a phase thereof is changed into low-temperature liquid-phase carbon dioxide, and the low-temperature liquid-phase carbon dioxide is supplied to the coolant circulation pipes 2 again in order to circulate therein.

The primary coolant circulating in the coolant apparatus 10 is, for example, a coolant R404a etc., the carbon dioxide as a secondary coolant is evaporated and vaporized by heat supplied from the ground G, and is cooled and condensed by heat exchange with water in the condenser 10B. The water warmed in the condenser 10B by heat of vaporization of the primary coolant (e.g., coolant R404a) is cooled by the cooling tower 10C.

In FIG. 1, coolant circulation pipes 2 are inserted into two freeze pipes 1 in parallel, but an arrangement of the coolant circulation pipes is not specifically restricted in this construction (it is possible to position the coolant circulation pipes in a serial arrangement). In a case that liquid-phase carbon dioxide as a coolant (secondary coolant) can keep cold energy enough to freeze the soil around the pipes, the coolant circulation pipes 2 may be inserted into a plurality of freeze pipes 1 in serial arrangement.

A freeze pipe may be a casing adopted from for drilling equipment, for instance, in a condition buried in the ground, and protect a collapse of a borehole wall. It is possible to provide the coolant circulation pipes 2 in a borehole (not shown) being provided into the ground, without using of freeze pipes 1.

In the artificial ground freezing method shown in FIG. 1, liquid-phase carbon dioxide is applied or used as a secondary coolant, the liquid-phase carbon dioxide being supplied from an apparatus (not shown) on the ground cools the ground G or absorbs latent heat of vaporization from the ground G, and then freezes the ground. Accordingly, this method is better in thermal efficiency than a prior art method in which sensible heat of a (brine) coolant is applied.

Herein, the artificial ground freezing system shown in FIG. 1, liquid-phase carbon dioxide circulates in a closed system. In this system, it is not necessary to release coolant gas into the ground, and also, it is not necessary to release coolant gas into the atmosphere. Accordingly, since the artificial ground freezing method shown in FIG. 1 can reduce liquefied gas consumption quantity, the method shown in FIG. 1 is more effective in an economical aspect than a prior art method in which liquefied gas is used as a coolant. Additionally, in the artificial ground freezing method shown in FIG. 1, since coolant gas is not released at a construction site, oxygen concentration is not reduced and it is prevented that construction worker should be worked in an environment in which oxygen concentration is reduced and becomes an oxygen-deficient environment.

In addition, since the coefficient of viscosity of liquid-phase carbon dioxide is extremely small which is approximate 1/90 times the coefficient of viscosity of brine, it is possible to reduce cross-section of the second coolant circulation pipes and to increase the flow rate of the second coolant circulating in the second coolant circulation pipe.

Additionally, in a case that liquid-phase carbon dioxide circulates as a secondary coolant, there is a case that the liquid-phase carbon dioxide is vaporized while passing through the ground, and then, in this case, a mixture of a liquid-phase coolant and a gas-phase coolant flow in the coolant circulation pipes and the viscosity thereof is reduced further.

Accordingly, the artificial ground freezing system shown in FIG. 1 can reduce the diameter of a freeze pipe and employ a longer freeze pipe. Consequently, the artificial ground freezing system shown in FIG. 1 can reduce the capacity of the coolant circulation pump 11 to reduce machine rental costs and pump driving energy.

Figure 2:
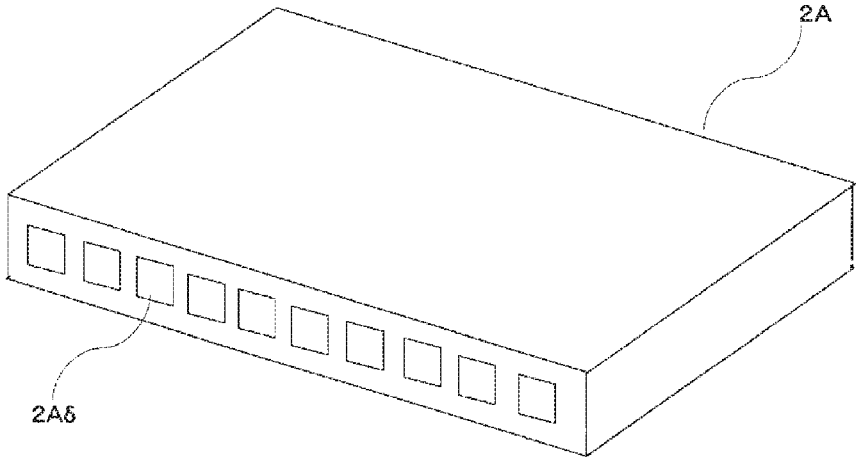
FIG. 2 is a perspective cross-sectional view showing a partially the coolant circulation pipe according to one of the embodiments of the present invention.

Then, in the system shown in FIG. 1, since the cross-section area of the coolant circulation pipes 2 for flowing liquid-phase carbon dioxide can be reduced, the flat member shown in FIG. 2 (having a micro-coolant passage 2Aδ) can be used as the coolant circulation pipe 2A (first coolant circulation pipe: e.g., aluminum).

In FIG. 2, a first coolant circulation pipe 2A being entirely made of a flat member includes a micro channel structure having a plurality of micro-coolant passages 2Aδ (10 micro-coolant passages in the embodiment shown) a cross-section of each of which is quadrangle (rectangle). The first coolant circulation pipe 2A is made of e.g., aluminum and excellent in thermal characteristics typical of a micro channel structure.

In FIG. 2, a cross-section of the micro-coolant passage 2Aδ is rectangle in order to increase a contact area between the inner peripheral surface of the micro-coolant passage 2Aδ and a coolant (for example, contact area between an aluminum micro-coolant passage 2Aδ and a coolant), and then, to improve an effect of freezing of a coolant. However, it is possible to make the cross-section of the micro-coolant passage 2Aδ non-rectangle (e.g., circle).

Additionally, in this specification, the coolant circulation pipe 2A (first coolant circulation pipe) being in the form of flat member shown in FIG. 2, can be referred to as "micro channel." Also, in this specification, a coolant circulation pipe 3C, in the form of hollow cylinder (pipe) shown in FIGS. 11 to 14, can be referred to as "micro channel."

Figure 3:
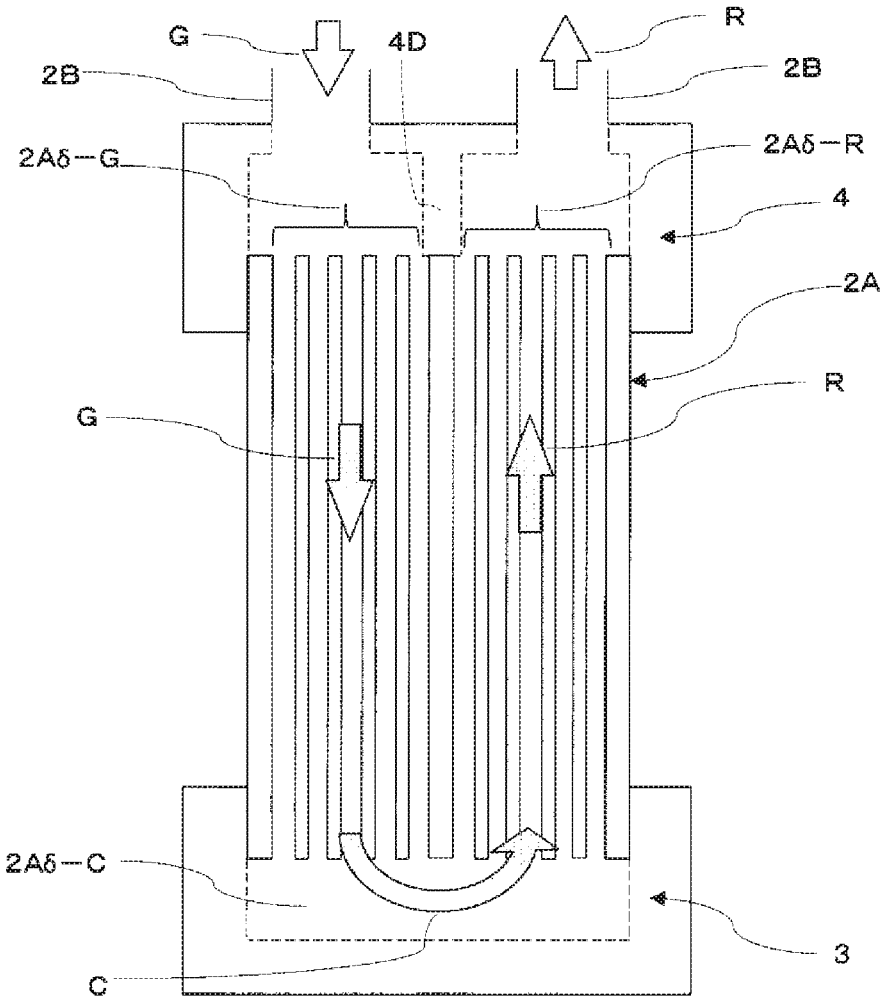
FIG. 3 is an explanatory drawing showing coolant circulation pipes, a plugging member and a connecting member according to the first embodiment of the present invention.

According to the first embodiment of the present invention, when a first coolant circulation pipe 2A is provided in a freeze pipe 1 (casing), as shown in FIG. 3, a bottom socket 3 (plugging member) is brazed on the bottom (underground end) of the first coolant circulation pipe 2A (micro channel). The connection between the first coolant circulation pipe 2A and the bottom socket 3, however, may be carried out by means of a non-brazing method.

In FIG. 3, micro-coolant passages 2Aδ-G provided on the left side in the first coolant circulation pipe 2A (5 micro-coolant passages provided on the left side out of 10 micro-coolant passages 2Aδ in FIG. 3) correspond to a coolant supply side, and micro-coolant passages 2Aδ-R provided on the right side (5 micro-coolant passages provided on the right side out of 10 micro-coolant passages 2Aδ) correspond to a coolant return side that returns to a coolant apparatus 10 (FIG. 1).

In FIG. 3, the micro-coolant passages 2Aδ-G provided on the left side and the micro-coolant passages 2Aδ-R provided on the right side are communicated each other by the bottom socket 3. In other words, in the first embodiment, one first coolant circulation pipe 2A (micro channel) comprises pipes on a coolant supply side and pipes on a coolant return side.

In FIG. 3, the bottom socket 3 is provided with a communicating portion 2Aδ-C for communicating the micro-coolant passages 2Aδ-G on the coolant supply side with the micro-coolant passages 2Aδ-R on the coolant return side.

The liquid-phase carbon dioxide (secondary coolant) supplied from the coolant supply side (e.g. on the ground) flows in the micro-coolant passages 2Aδ-G on the coolant supply side (arrow G), passes through the communicating portion 2Aδ-C in the bottom socket 3 (arrow C), flows in the micro-coolant passages 2Aδ-R on the coolant return side (arrow R), and returns to the coolant apparatus 10 (FIG. 1). Numeral 4D in FIG. 3 indicates a dividing wall which is provided so that a coolant on the coolant supply side and a coolant on the coolant return side are not mixed.

A top socket 4 (connecting member) is brazed to the above-ground side of a first coolant circulation pipe 2A (micro channel). The connection between the first coolant circulation pipe 2A and the top socket 4, however, may be carried out by means of a non-brazing method.

The micro-coolant passages 2Aδ-G on the coolant supply side and the micro-coolant passage 2Aδ-R on the coolant return side of the first coolant circulation pipe 2A are connected by the top socket 4 with a coolant supply side and a coolant return side of coolant circulation pipes 2B (second coolant circulation pipes), respectively, a cross-section of which are circular cross-section. The supply side and the return side of the coolant circulation pipes 2B with a circular cross-section are connected with a coolant supply side and a coolant return side (cooling side) of a coolant apparatus 10 (FIG. 1) of liquid-phase carbon dioxide, respectively.

Figure 4:
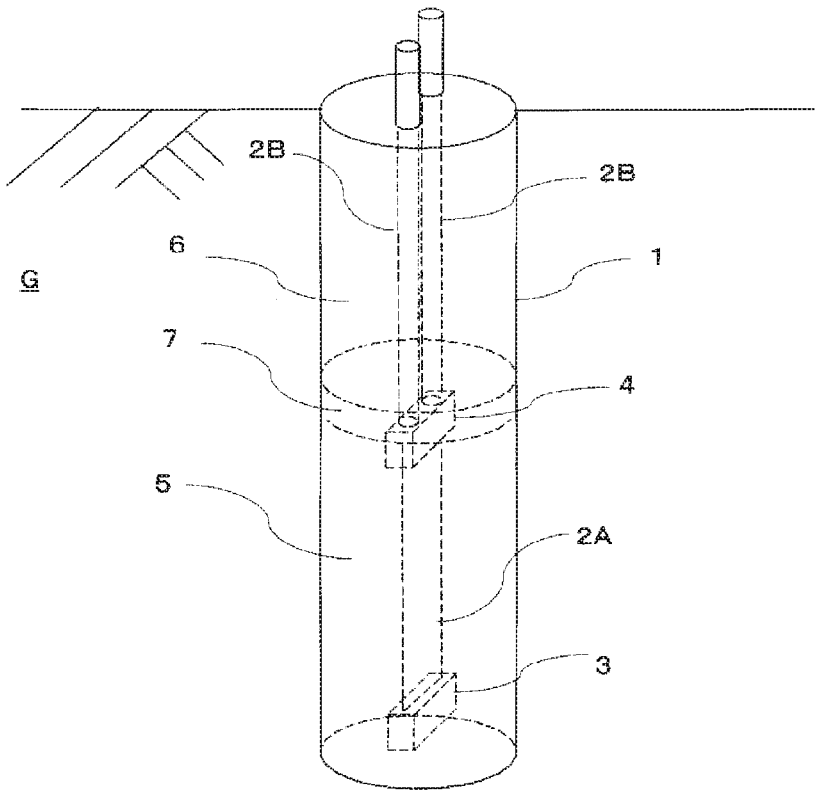
FIG. 4 is a perspective view showing constructions of the freeze pipe according to the first embodiment.
Figure 5:
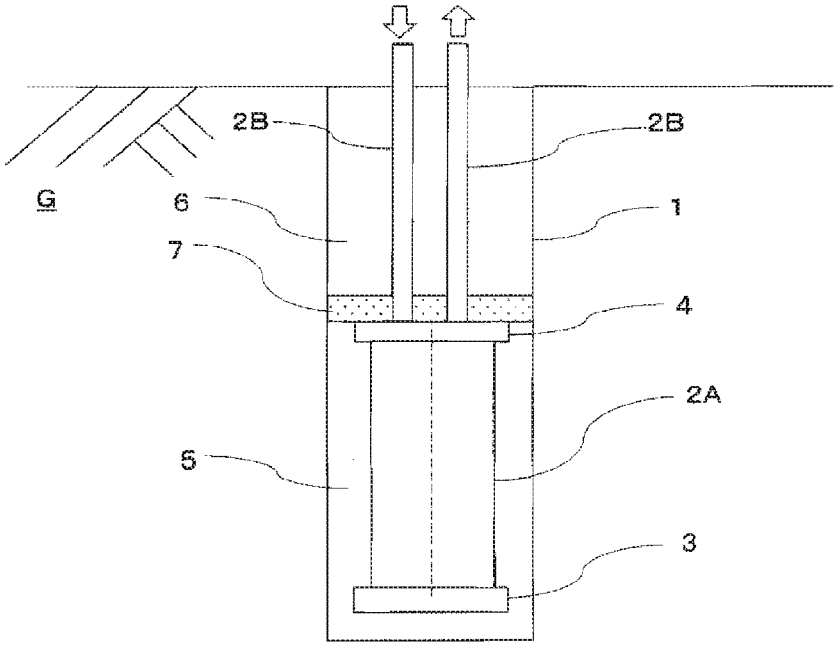
FIG. 5 is a front cross-sectional view of the freeze pipe shown in FIG. 4.

The constructions of the partly freeze pipe structure of the first embodiment are shown in FIGS. 4 and 5.

In FIGS. 4 and 5, the system is constructed so as to freeze a lower region from a packer 7 in the ground G merely, and not freeze upper region from the packer 7 in the ground G.

In FIGS. 4 and 5, in order to inhibit heat exchange between the liquid-phase carbon dioxide in the second coolant circulation pipes 2B (pipes with a circular cross-section) extending in a non-frozen region of the ground G and the ground region being above the packer 7, an insulator 6 is filled in a space between the second coolant circulation pipes 2B (pipes with a circular cross-section) and a casing 1 (freeze pipe). Then, the packer 7 is preferably made of an insulator.

Herein, a diameter of the second coolant circulation pipes 2B is set to be small enough so as to keep (ensure) a space for filling the insulator 6. Subsequently, the insulator 6 (e.g., urethane foam, styrene foam) is filled from the bottom of the casing 1 through a filling pipe (not shown) so as to be filled in a space between the second coolant circulation pipes 2B and the casing 1.

On the other hand, to efficiently perform heat exchange between the liquid-phase carbon dioxide in the first coolant circulation pipe 2A (micro channel) extending in a region of the ground G to be frozen and the ground G of the lower region from the packer 7, a heat transfer fluid 5 is filled in a space between the first coolant circulation pipe 2A and the casing 1. The heat transfer fluid 5 is preferably excellent in heat transfer, but may be easily available tap water.

In the embodiment shown in FIGS. 4 and 5, a space is sufficiently provided between the flat first coolant circulation pipe 2A (micro channel) and the casing 1 in which the heat transfer fluid 5 is filled.

Herein, in a case that the insulator 6 is a fluid, in order to mix the insulator 6 (fluid) and the heat transfer fluid 5, it is necessary to divide a region of the ground to be frozen and a region of the ground not to be frozen inside of the casing 1 in a fluid-tight manner, by means of the packer 7 which is located and expanded at an area between a region to be frozen and a region not to be frozen.

On the other hand, when the insulator 6 is a cloth (or flexible and flat) member, the cloth insulator 6 is wound onto the second coolant circulation pipes 2B to reduce heat exchange between the liquid-phase carbon dioxide in the second coolant circulation pipes 2B and the ground. After the cloth insulator 6 is wound onto the second coolant circulation pipes 2B to be fixed (The state that the cloth insulator 6 is wound is not shown), the heat transfer fluid 5 is filled. In a case that a cloth insulator 6 is used, since there is not possibility for generating a situation that the insulator 6 and the heat transfer fluid 5 are mixed, the packer 7 is not necessary.

In ground freezing work, a casing 1 of a freeze pipe is provided in a borehole drilled for placing freeze pipes to retain a borehole wall. In this specification, the casing is sometimes referred to as "freeze pipe."

In a case that high-pressure water is used as a fluid for cutting or drilling a borehole, means for preventing water infiltration (not shown) is provided, and that the water in the casing 1 must be discharged by means of water discharge apparatus (not shown) such as a pump, it is possible to discharge the water in the casing 1 by means of water discharge means such as a pump, after the casing 1 is provided, the means for preventing water infiltration (not shown) is installed at the tip portion (underground end portion) of the casing 1. After the water is discharged, the first coolant circulation pipe 2A (micro channel) having a bottom socket 3 and a top socket 4, which are brazed on the first coolant circulation pipe 2A, is positioned in the casing 1.

Figure 8:
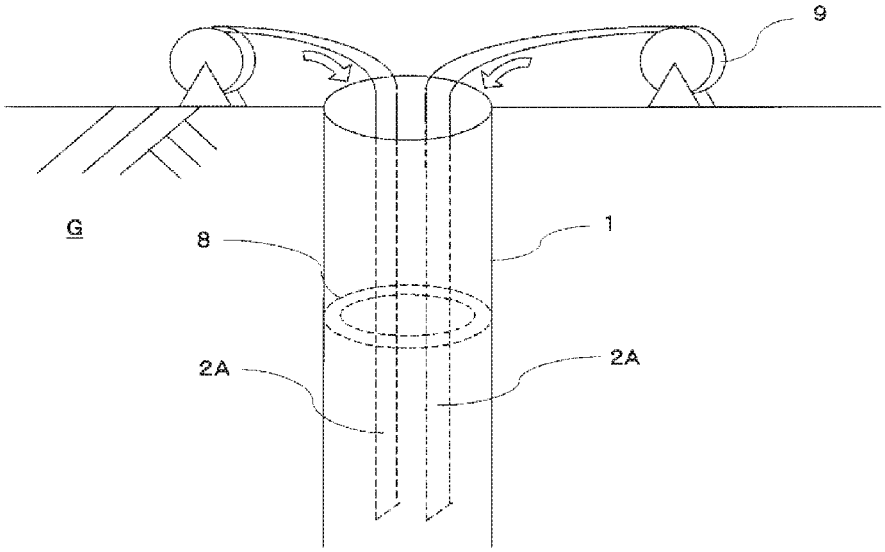
FIG. 8 is a perspective view showing a situation that the coolant circulation pipe is inserted into the freeze pipe according to the second embodiment.
Figure 16:
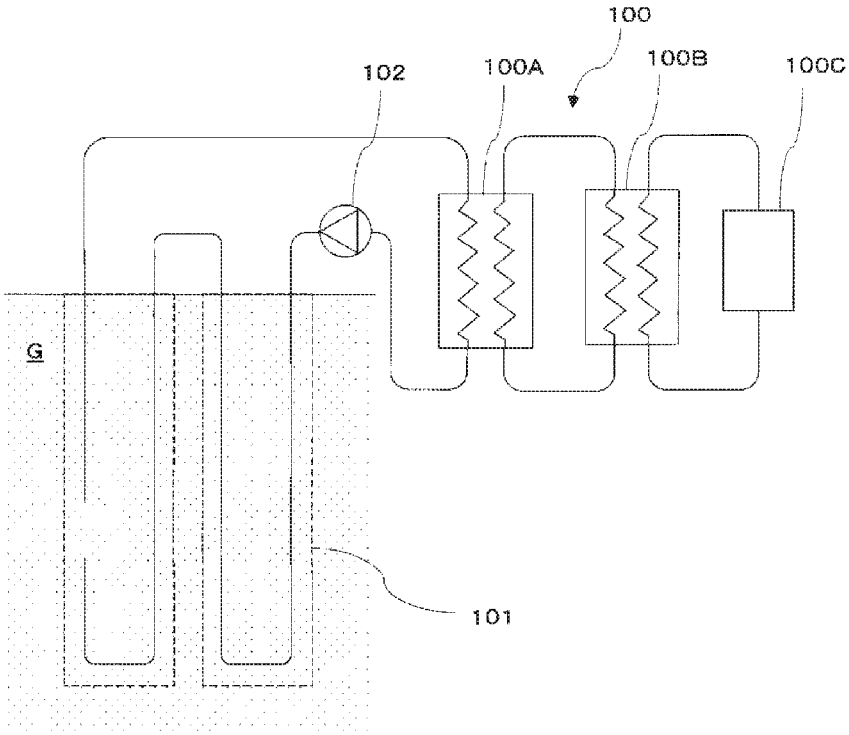
FIG. 16 is an explanatory drawing showing a brine heat exchange cycle.

According to the first embodiment shown in drawings, the first coolant circulation pipe 2A (micro channel) and the second coolant circulation pipes 2B (pipe with a circular cross-section) are used as a coolant circulation pipe 2. Herein, since the first coolant circulation pipe 2A (micro channel) is flat and made of aluminum, it is possible to bend and stretch the first coolant circulation pipe. Consequently, as shown in FIG. 8, a micro channel 2A, the length of which is equivalent to a vertical depth of 100 m of frozen ground to be formed underground, can be prepared by rolling a plugging member 3 and a connecting member 4 at a plant, transported at a construction site and stretched linearly to be directly inserted and provided into a borehole (casing 1).

The second coolant circulation pipes 2B (pipe with a circular cross-section) are small in diameter, it is possible to connect the second coolant circulation pipes 2B of certain length each other by means of a screw pipe-type joint, etc. Likewise, the second coolant circulation pipes 2B with a circular cross-section and the top socket 4 can be joined with a screw pipe-type joint, etc. Accordingly, the second coolant circulation pipes 2B can be connected with the first coolant circulation pipe 2A (micro channel) through the top socket 4 provided in the borehole (casing 1).

Insertion of the first coolant circulation pipe 2A (micro channel) into a freeze pipe requires no repeated welding of pipes of fixed length (different from double pipes as a prior art brine method).

By means of a construction without repeating welding of pipes of fixed length, in the first embodiment, constructional costs can significantly be reduced and leakage of a secondary coolant from welded pipes at a site is prevented.

No welding of first coolant circulation pipes 2A of fixed length (micro channel) can reduce effort for installing each freeze pipe. Moreover, both a first coolant circulation pipe 2A (micro channel) and second coolant circulation pipes 2B (pipes with a circular cross-section) are small in cross-section, enabling the diameter of the casing 1 (freeze pipe) to be smaller, and the construction efficiency and the construction period to be higher and shorter, respectively. Consequently, the horizontal interval between the freeze pipe and the connecting pipe can be reduced and the speed of freezing can be increased more preferably than a prior art brine method. By these advantages, a frozen wall can be formed within a short period of time.

According to the first embodiment having high construction efficiency, the horizontal interval between freeze pipes can be reduced and thermal conductive properties of cold energy in the ground can be improved.

Additionally, according to the first embodiment shown, since the heat transfer fluid 5 is filled in a region in the freeze pipe 1 corresponding to a region of the ground to be frozen, and an insulator 6 is provided in a region corresponding to a region of the ground not to be frozen, it is possible to freeze merely the ground to be frozen efficiently.

Although not shown in FIGS. 3 to 5, a plurality of first coolant circulation pipes 2A (micro channel) can be inserted into the freeze pipe. Accordingly, the flow rate of a coolant (carbon dioxide) can be increased and the method of freezing the ground can efficiently be implemented.

Figure 15:
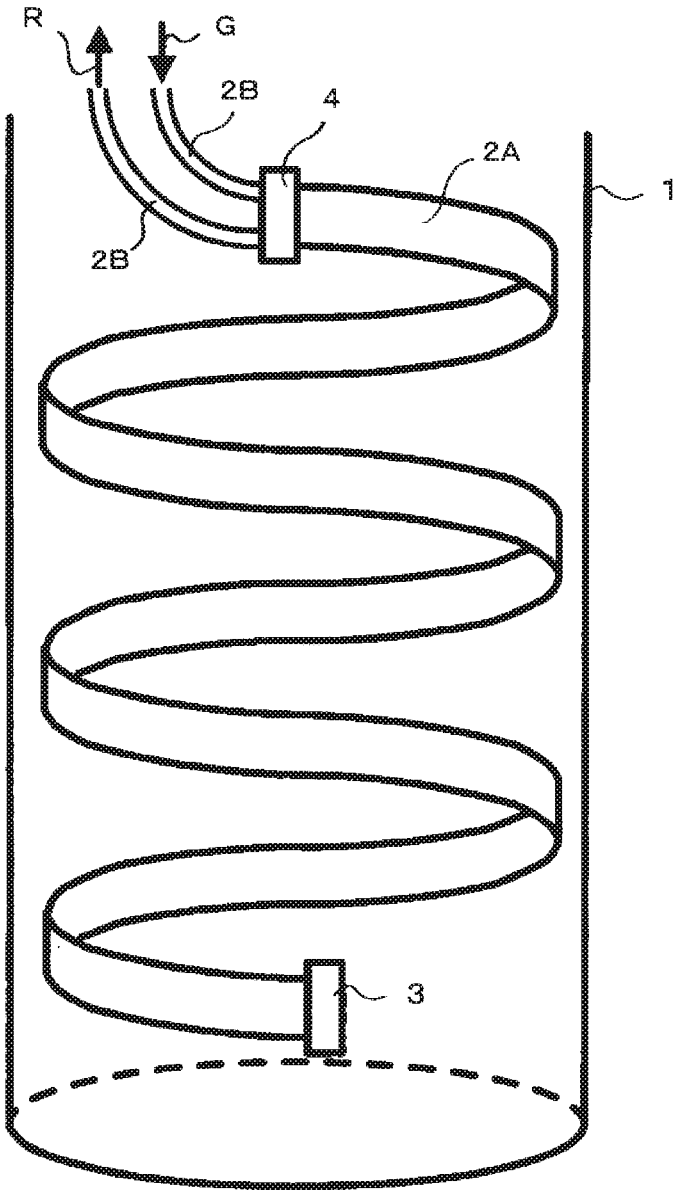
FIG. 15 is an explanatory drawing showing an alternative example of the first embodiment.

In the first embodiment shown in FIGS. 1 to 5, first coolant circulation pipes 2A (micro channel) are extended in parallel with the freeze pipe 1. As shown in FIG. 15, however, first coolant circulation pipes 2A can spirally be extended.

BY means of extending first coolant circulation pipes 2A spirally, a distance of a coolant (carbon dioxide) flowing in a first coolant circulation pipe 2A is long and the efficiency of discharging cold energy retained in the coolant into the soil is improved.

Other constructions and effects in an alternative embodiment in FIG. 15 are the same as in the first embodiment shown in FIGS. 1 to 5.

Herein, the bottom socket (plugging member) is not restricted to the embodiment shown in FIG. 3. One example shown in FIG. 17 is that the width of the bottom socket 3A (plugging member) (in horizontal direction in FIG. 17) is determined at the same as that of the first coolant circulation pipe 2A (micro channel) to eliminate lateral bulge in the bottom socket 3A (in horizontal direction in FIG. 17) for achieving easier pipe insertion.

Figure 18:
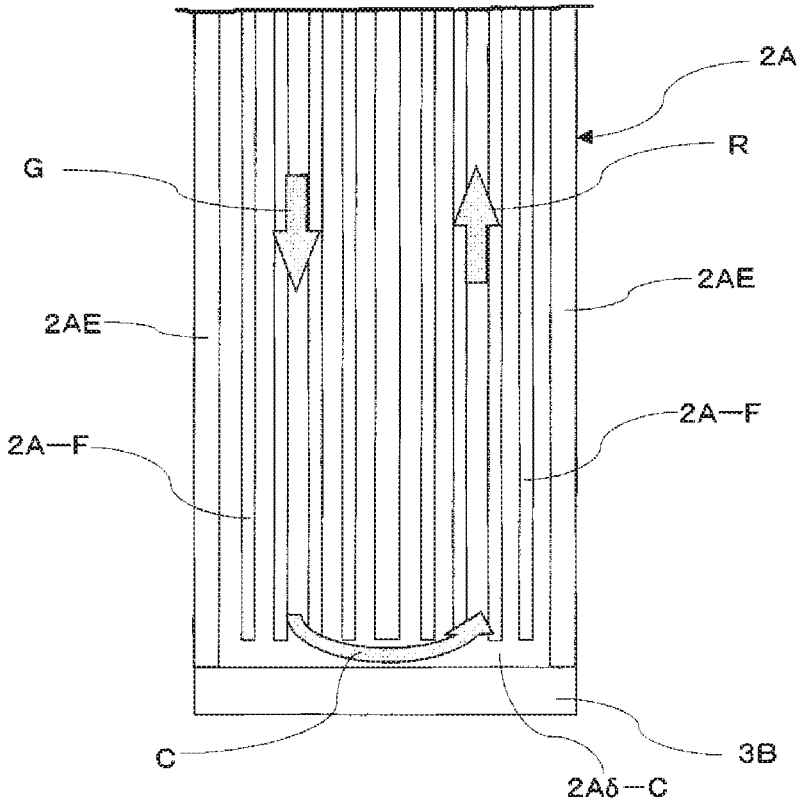
FIG. 18 is an explanatory drawing showing a further alternative example of the plugging member according to the first embodiment.

As shown in FIG. 18, a "lid"-shaped bottom socket 3B (plugging member) can be provided at an underground end (lower end in FIG. 18) of the first coolant circulation pipe 2A (micro channel). Specifically, to provide a communicating portion 2Aδ-C, both edges 2AE of the first coolant circulation pipe 2A (micro channel) vertically extend longer than partition walls 2A-F toward an underground end (lower side in FIG. 18) by a predetermined dimension (dimension necessary to secure the vertical length of the communicating portion 2Aδ-C). By forming a lid-shaped bottom socket 3A (plugging member), the bottom socket 3A can easily and assuredly be connected with the first coolant circulation pipe 2A (micro channel).

Figure 17:
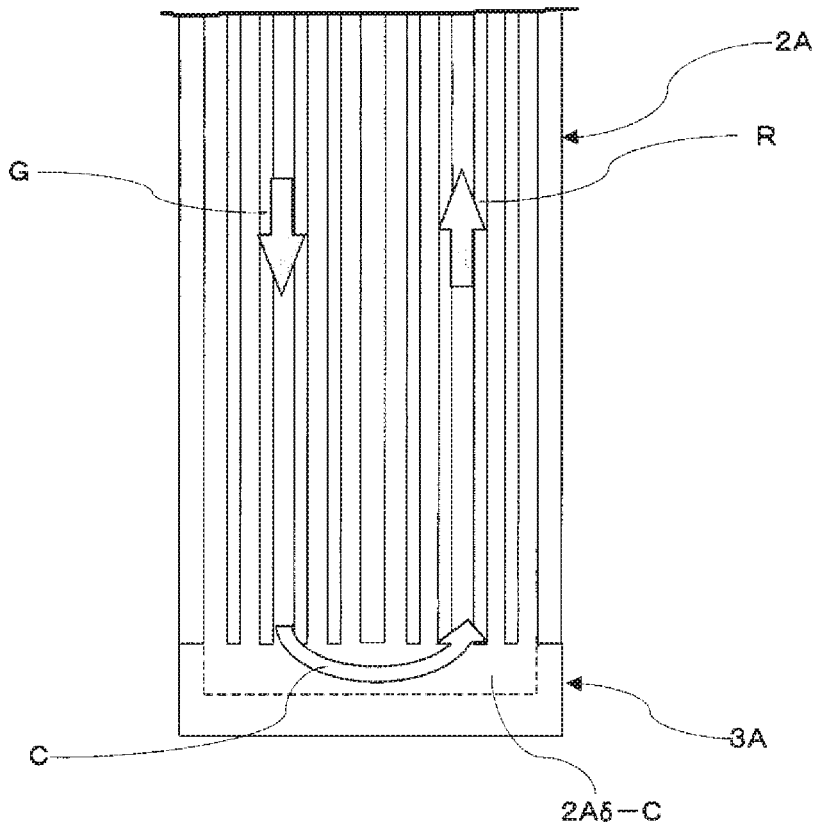
FIG. 17 is an explanatory drawing showing an another example of the plugging member according to the first embodiment.

Other constructions of the bottom sockets 3A, 3B (plugging member) shown in FIGS. 17 and 18 are the same as in the embodiment in FIG. 3.

The top socket (connecting member) is not restricted to the embodiment shown in FIG. 3, as with the bottom socket (plugging member).

Figure 19:
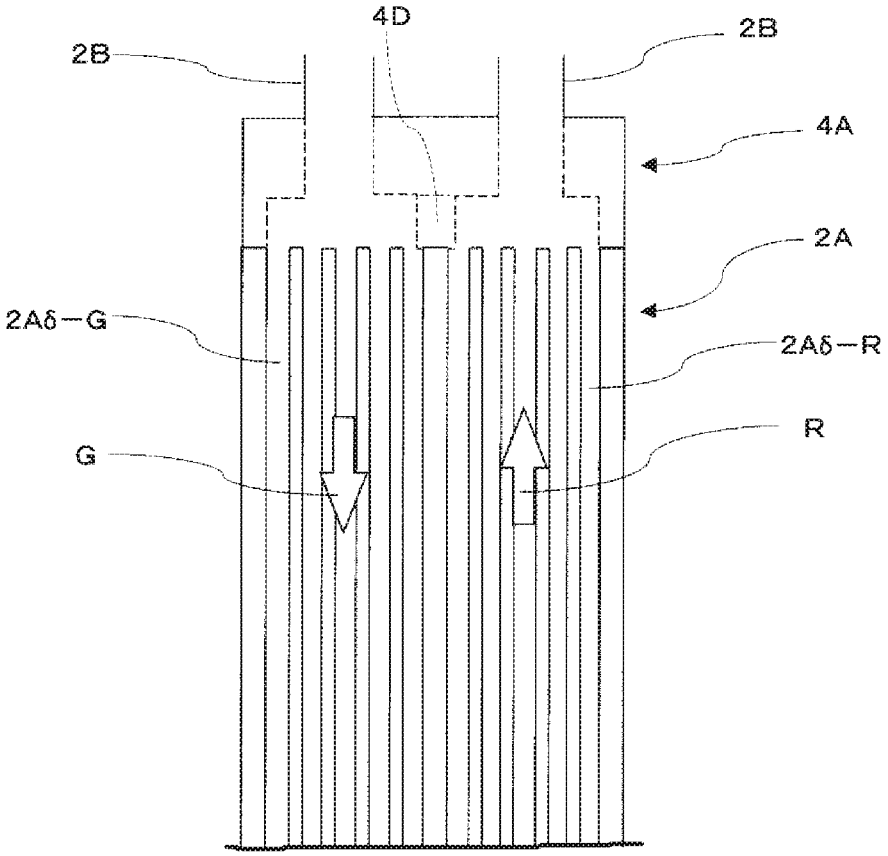
FIG. 19 is an explanatory drawing showing an alternative example of the connecting member according to the first embodiment.

The width of the top socket 4A (connecting member) shown in FIG. 19 (in horizontal direction in FIG. 19) is the same as the width of the first coolant circulation pipe 2A (micro channel), and the extended portion of the top socket 4A is not wider than the first coolant circulation pipe 2A (in horizontal direction in FIG. 19). Accordingly, the socket 4A can be easily inserted into the first coolant circulation pipe 2A.

In FIG. 19, numeral 4D refers to a dividing wall, and the dividing wall 4D divides a coolant for flowing in a micro-coolant passage 2Aδ-G on a coolant supply side and a coolant for flowing in a micro-coolant passage 2Aδ-R on a coolant return side to prevent from mixing.

Figure 20:
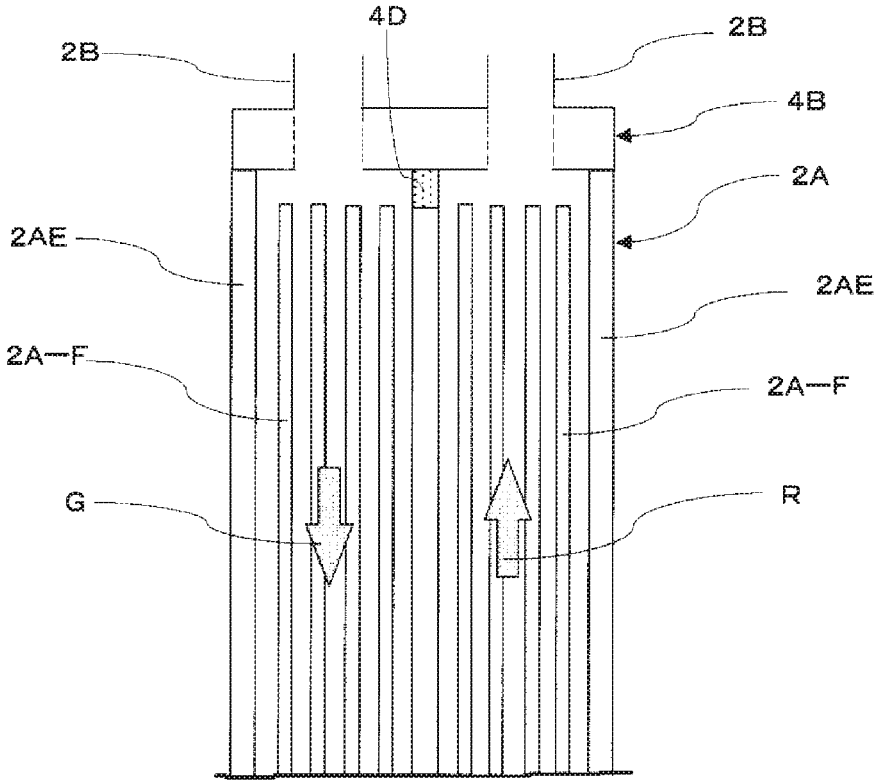
FIG. 20 is an explanatory drawing showing a further alternative example of the connecting member according to the first embodiment.

The bottom socket 3B (plugging member) shown in FIG. 20 is provided as a "lid"-shaped member on a coolant supply side (upper end in FIG. 20) of the first coolant circulation pipe 2A (micro channel).

Also, in this case, both edges 2AE of the first coolant circulation pipe 2A (micro channel) are projected vertically in comparison with partition walls 2A-F in a direction toward an end on a coolant supply side (upward direction in FIG. 18) by a predetermined dimension, a space is formed for communicating the second coolant circulation pipe 2B on the coolant supply side and a micro-coolant passage 2Aδ-G on the coolant supply side, and a space is formed for communicating the micro-coolant passage 2Aδ-G on the coolant return side and the second coolant circulation pipe 2B on the coolant return side. A dividing wall 4D is also prepared.

By forming a lid-shaped top socket 4A (connecting member), the socket 4A can be connected with a first coolant circulation pipe 2A (micro channel) easily and surely.

Other constructions of the top sockets 4A, 4B (connecting member) in the FIGS. 19 and 20 are the same as the embodiment in in FIG. 3.

Herein, a dividing wall 4D is fixed on the top socket 4 shown in FIG. 3, the top socket 4A shown in FIG. 19 and the top socket 4B shown in FIG. 20. However, a dividing wall 4D-A is moveably formed on a top socket 4C shown in FIG. 21 in arrow H direction. This means that the dividing wall 4D may be fixed on the top sockets 4, 4A, and 4B (connecting member), or may be movable as the dividing wall 4D-A on the top socket 4C shown in FIG. 21 (connecting member).

Figure 21:
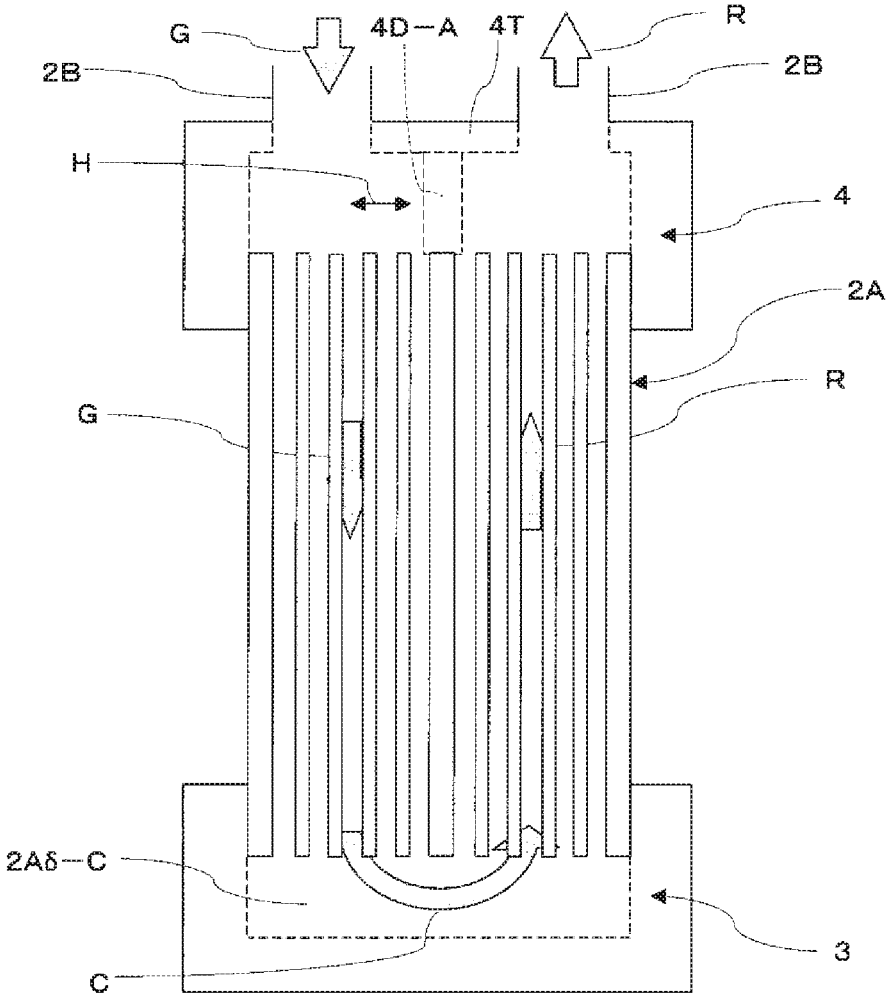
FIG. 21 is an explanatory drawing showing a more one example of the connecting member according to the first embodiment not shown in FIGS. 19 and 20.

Although not clearly shown in FIG. 21, the dividing wall 4D-A moves along a top wall 4T of the top socket 4C in arrow H direction. This construction for moving the dividing wall 4D-A n the arrow H direction can be provided by a known structure including a rack and a pinion, with an electric motor (not shown) as a power source.

A second embodiment of the present invention will be described with reference to FIGS. 6 to 9.

In the first embodiment shown in FIGS. 3 to 5, a first coolant circulation pipe 2A, composed of micro-coolant passages, is provided only near the bottom in a freeze pipe 1 (casing), and second coolant circulation pipes 2B (pipes with a circular cross-section) connected with the first coolant circulation pipe 2A through a top socket 4 (connecting member) are also inserted into the freeze pipe 1 (casing).

On the other hand, in the second embodiment, the first coolant circulation pipe 2A (micro channel) is inserted into a freeze pipe 1 (casing) throughout a vertical direction area (in vertical direction in FIG. 6) corresponding to the freeze pipe 1, while second coolant circulation pipes 2B with a circular cross-section are not inserted into the freeze pipe 1 (casing).

Figure 6:
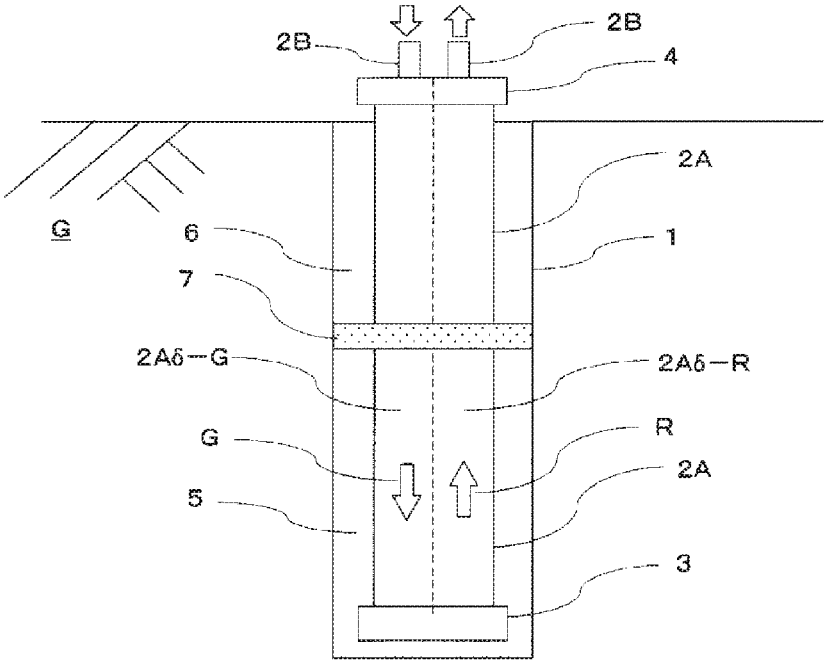
FIG. 6 is a front cross-sectional view showing a freeze pipe according to the second embodiment of the present invention.

In FIG. 6, the first coolant circulation pipe 2A (micro channel) is provided along the freeze pipe 1 (casing) vertically.

Figure 7:
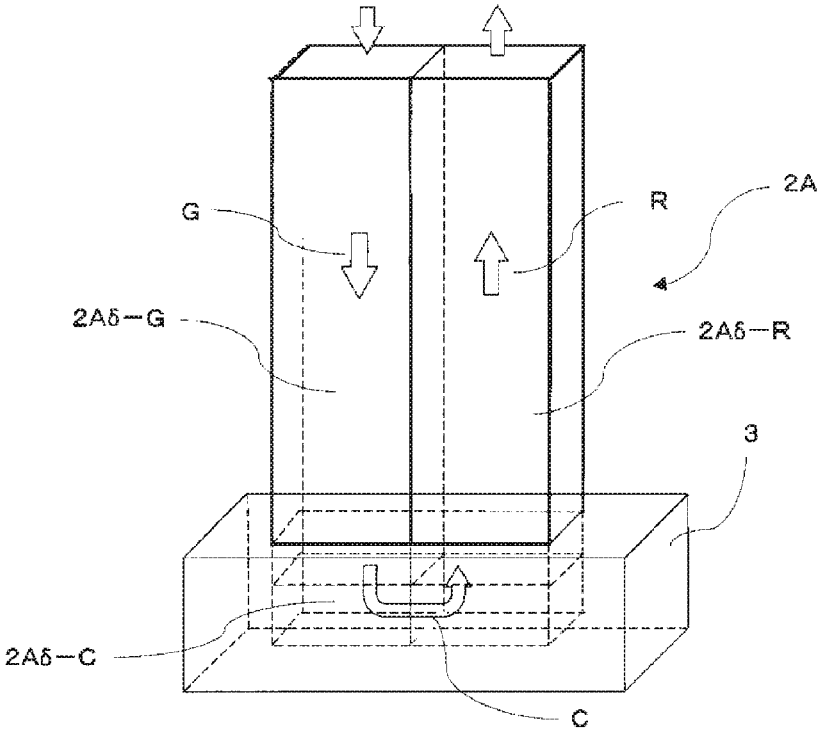
FIG. 7 is an explanatory drawing showing an end of the coolant circulation pipe according to the second embodiment.

In the first coolant circulation pipe 2A (micro channel), micro-coolant passages 2Aδ-G on the left side (5 micro-coolant passages on the left side in FIG. 6 in 10 micro-coolant passages 2Aδ shown in FIG. 2) correspond to a coolant supply side (arrow G), and micro-coolant passages 2Aδ-R in the right side region (5 micro-coolant passages on the right side in FIG. 6 in 10 micro-coolant passages 2Aδ shown in FIG. 2) correspond to a coolant return side (arrow R) that returns to a coolant apparatus 10 (FIG. 1). FIGS. 6 and 7 show micro-coolant passages 2Aδ-G on a coolant supply side from the ground and micro-coolant passages 2Aδ-R on a coolant return side that returns to the ground, each composed of 5 micro-coolant passages 2Aδ.

In FIG. 6, on the ground being above the freeze pipe 1 (casing), the top of the first coolant circulation pipe 2A (micro channel) is connected with the top socket 4 and the socket is connected with the second coolant circulation pipes 2B (pipe with a circular cross-section), the coolant supply side of the first coolant circulation pipe 2A is connected with the coolant supply side of the second coolant circulation pipe 2B, and also, the coolant return side of the first coolant circulation pipe 2A is connected with the coolant return side of the second coolant circulation pipe 2B.

The coolant circulation pipes 2B with a circular cross-section are connected with the coolant supply side and the coolant return side (cooling side) of the coolant apparatus 10 (FIG. 1) of liquid-phase carbon dioxide. This means that the construction of the freezing system on the ground in FIG. 6 is the same as the construction where the top of the coolant circulation pipe 2A (micro channel) is connected with the top socket 4 in the first embodiment shown in FIG. 3.

In the second embodiment, the first coolant circulation pipe 2A can also spirally be extended (FIG. 15).

As shown in FIG. 7, at the lower portion of the first coolant circulation pipe 2A (micro channel), a bottom socket 3 (plugging member) is brazed on the bottom of the first coolant circulation pipe 2A, as shown in FIG. 3 (as the first embodiment), so that the micro-coolant passages 2Aδ-G on the coolant supply side are communicated with the micro-coolant passages 2Aδ-R on the coolant return side through the bottom socket 3, and the communicating portion 2Aδ-C is formed.

The freezing system according to the second embodiment, as shown in FIG. 6, provides the partly freeze pipes structures of a partial freeze pipe for freezing merely a partial region of a ground G.

In FIG. 6, as described in reference with FIGS. 4 and 5, the region of the ground to be frozen is an area below the packer 7, and therefore, the heat transfer fluid 5 is filled in a space between the first coolant circulation pipe 2A (micro channel) extending in a region below the packer 7 and the casing 1.

On the other hand, a region of the ground not to be frozen is an area above the packer 7, and therefore, an insulator 6 is filled in a space between the first coolant circulation pipe 2A (micro channel) extending in a region above the packer 7 and the casing 1 (freeze pipe).

Further, FIG. 6 shows a case that the insulator 6 is a fluid, and the region of the ground to be frozen and the region of the ground not to be frozen are divided in fluid-tight manner by expanding the packer 7. This construction is carried out in order to prevent mixture of the fluid insulator 6 and the heat transfer fluid 5.

On the other hand, in a case that the insulator 6 is made of cloth (flexible plate-shaped body) and is wound onto the first coolant circulation pipe 2A (micro channel) in order to control heat exchange between the liquid-phase carbon dioxide as a coolant and the ground, since the insulator 6 and the heat transfer fluid 5 are not mixed, it is not necessary to provide the packer 7.

In a prior art brine method, a freeze pipe buried in the ground is constructed as a double-pipe in order to comprise a supply side path and a return side path of brine (secondary coolant). On the other hand, in the second embodiment shown in the drawings, since one of the first coolant circulation pipe 2A (micro channel) can be inserted into the hollow circular pipe casing 1, the coolant pipes can be easily provided and the work efficiency can be improved extremely.

Also, as like as the first embodiment, since the first coolant circulation pipe 2A (micro channel) is shaped in flat manner and made of aluminum, it is possible to bend and stretch the first coolant circulation pipe 2A. Accordingly, as shown in FIG. 8, a micro channel for the first coolant circulation pipe 2A, the length of which corresponds to a vertical depth of 100 m of frozen ground to be formed underground, is connected with a plugging member 3 and a connecting member 4 by brazing, is rolled at a plant, is transported at a construction site, is stretched linearly by a micro channel rolling machine 9 to be directly inserted, and is provided into a borehole (freeze pipe 1). Consequently, welding of double pipes of fixed length, which is required in a prior art brine method, is not required, and therefore, construction work of providing the coolant pipes is significantly reduced. Also, potential leakage of the secondary coolant from portions being welded at the construction site is prevented.

As shown in FIG. 8, in a case that two or more micro channels 2A (first coolant circulation pipes) are buried (buried) in the ground, it is preferable that a spacer 8 for horizontally holding each of the micro channels 2A is provided, in order to carry out smooth insertion of a plurality of micro channels 2A into a single borehole (freeze pipe 1), to prevent a contact of a plurality of micro channels 2A each other after said insertion, to prevent a contact of the micro channels 2A with an inner wall of the borehole (freeze pipe 1), and more advantageously, to keep an appropriate horizontal interval of the plurality of micro channels 2A each other.

The spacer 8, as shown in FIG. 8, is provided so as to make a space between a plurality of micro channels (first coolant circulation pipes 2A).

Figure 9:
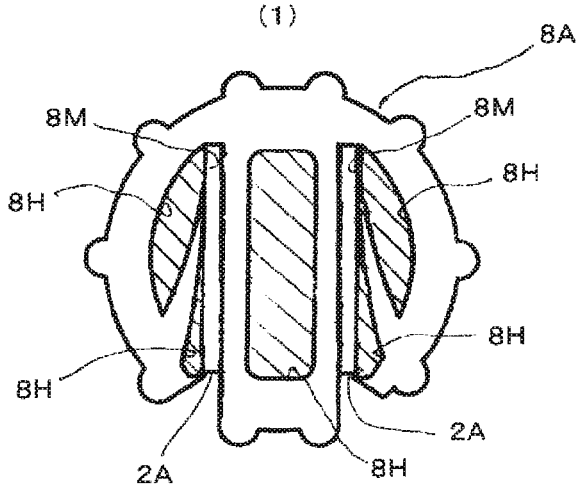
FIG. 9 is a plan view showing a spacer according to the second embodiment which spacer is used in a case that a plurality of the coolant circulation pipes are inserted into the freeze pipe.
Figure 9:
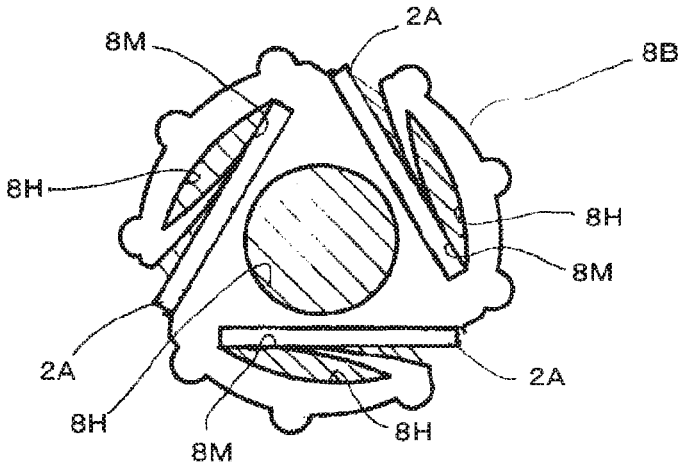
Figure 9:
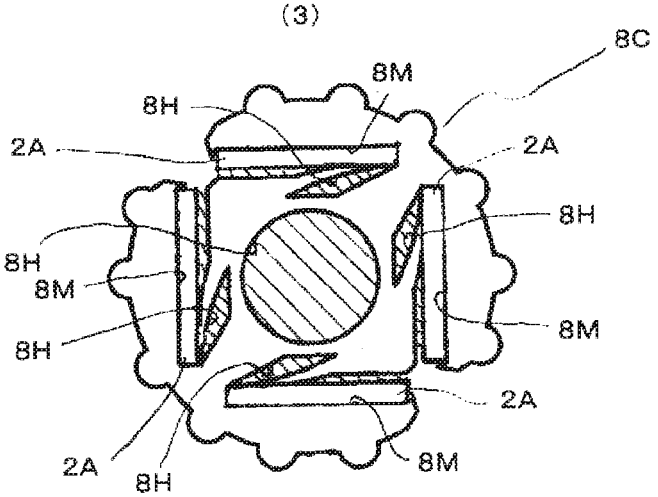

Typical shapes of the spacer 8 are shown in FIG. 9 (1), FIG. 9(2), and FIG. 9(3).

Since the shape of the spacer 8 varies according to the number of micro channels (the first coolant circulation pipes 2A) to be inserted into the borehole (freeze pipe 1), a spacer with numeral 8A shown in FIG. 9(1) is used in a case that two micro channels 2A should be inserted into the borehole, a spacer with numeral 8B shown in FIG. 9(2) is used in a case that three micro channels 2A should be inserted into the borehole, and a spacer with numeral 8C shown in FIG. 9(3) is used in a case that four micro channels 2A should be inserted into the borehole.

In order to insert the micro channels 2A into a borehole (freeze pipe 1) and to fill the heat transfer fluid 5 after insert of the micro channel 2A, a plurality of openings 8M are formed so as to pass the micro channel 2A there-through and openings 8H (hatched) are formed so as to fill the heat transfer fluid 5 there-through, the openings 8M and 8H are formed in spacers 8A to 8C shown in FIG. 9(1), FIG. 9 (2), and FIG. 9(3) respectively.

The spacer 8 is preferably made of metal excellent in heat transfer, but may be made of easily available inexpensive plastics.

In addition, the above-mentioned spacers 8 can be employed in the first embodiment.

The second embodiment includes the applications to radially outwardly provided freeze pipes in tunnels and horizontal freeze pipes in shafts.

Other constructions and effects of the second embodiment shown in FIGS. 6 to 9 are the same as in the first embodiment shown in FIGS. 3 to 5.

Figure 10:
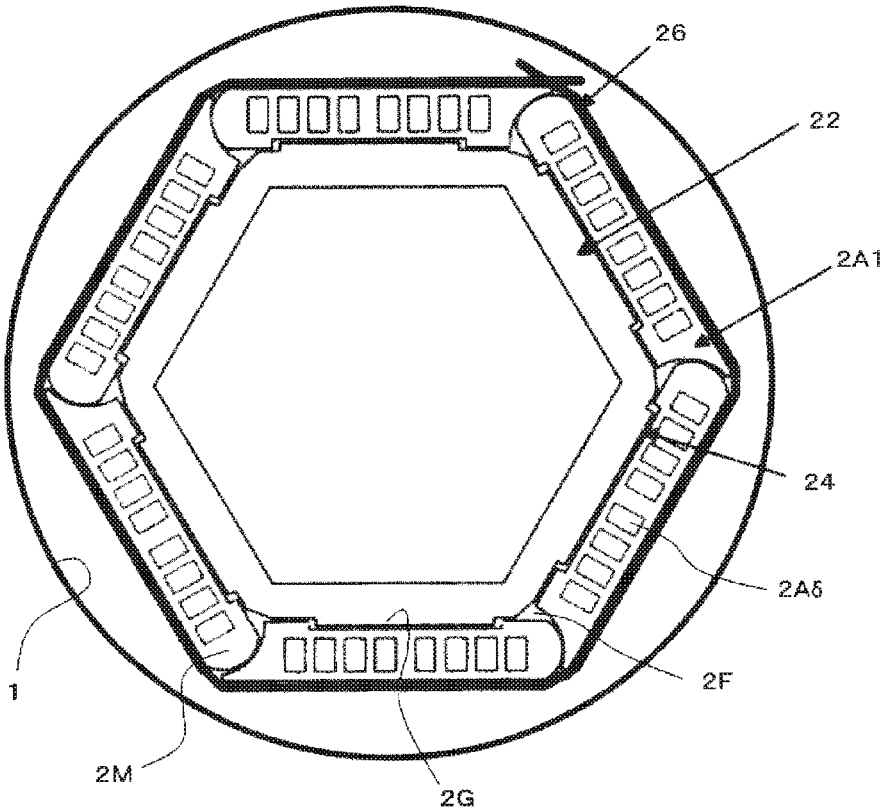
FIG. 10 is a cross-sectional view showing a situation that a plurality of coolant circulation pipes are inserted into the freeze pipe according to an alternative example of the first embodiment and the second embodiment.

An alternative embodiment of the first embodiment and the second embodiment shown in FIGS. 3 to 9 is shown in FIG. 10. In FIG. 10, a plurality of coolant circulation pipes 2A1 as shown in FIGS. 3 to 9 are inserted into a freeze pipe 1.

In FIG. 10, 8 micro-coolant passages 2Aδ are formed inside of a flat coolant circulation pipe 2A1, having a female tenon 2F at one end and a male tenon 2M at the other end. A female tenon 2F of one coolant circulation pipe 2A1 and a male tenon 2M of its neighboring coolant circulation pipe 2A1 are engaged with each other to be arranged.

In FIG. 10, 6 flat coolant circulation pipes 2A1 are provided in the freeze pipe 1 in an overall hexagonal form.

An assembly jig 22 of a substantially hexagonal form is provided radially inwardly from 6 coolant circulation pipes 2A1 of an overall hexagonal form. The assembly jig 22 includes protrusions 24 each of which protrudes outwardly in radial direction. By engaging the protrusions 24 with positioning grooves 2G each of which recesses inwardly in radial direction from a coolant circulation pipe 2A1, the positions of the 6 coolant circulation pipes 2A1 are determined relative to the assembly jig 22. Accordingly, the assembly jig 22 and the 6 coolant circulation pipes 2A1 are integrally bundled by means of a cable tie 26.

The arrangement shown in FIG. 10 enables a plurality of coolant circulation pipes 2A1 to uniformly be provided in the freeze pipe 1 and the ground outside of the freeze pipe 1 to be efficiently cooled by carbon dioxide (coolant) flowing in a plurality of coolant circulation pipes 2A1.

Other constructions and effects of an alternative embodiment shown in FIG. 10 are the same as in the first embodiment and the second embodiment shown in FIGS. 3 to 9.

A third embodiment of the present invention will be described with reference to FIGS. 11 to 14.

Figure 11:
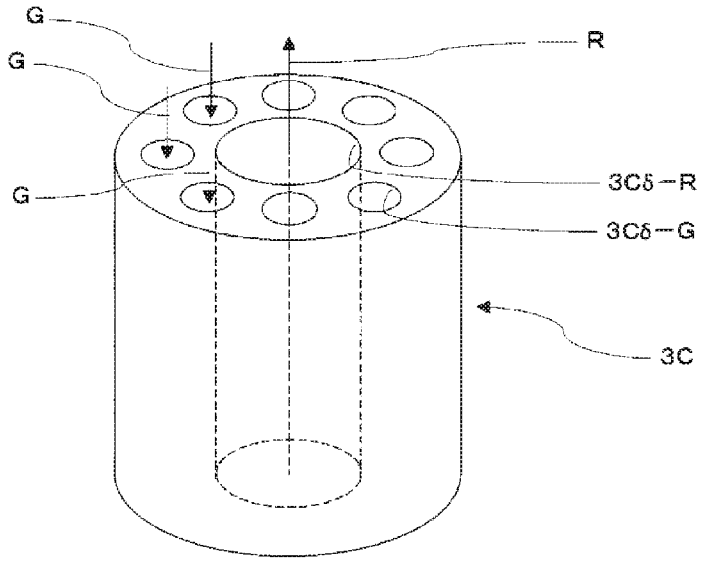
FIG. 11 is a perspective view showing a coolant circulation pipe according to a third embodiment of the present invention.

In FIG. 11, a coolant circulation pipe (micro channel) used in the third embodiment is denoted as numeral "3C." The coolant circulation pipe 3C is entirely formed of a hollow cylinder (pipe), and a plurality of micro-coolant passages 3Cδ-G (8 micro-coolant passages in FIG. 11) are formed in a radially outwardly located region. A radially inwardly located hollow portion 3Cδ-R constructs a coolant return path for returning a coolant to a coolant apparatus 10 (shown in FIG. 1), and also, an internal diameter of the radially inwardly located hollow portion 3Cδ-R is set so as to be larger than an internal diameter of a micro-coolant passages 3C δ-G.

The hollow portion of the coolant circulation pipe 3C may be written by phrases "a coolant return path 3Cδ-R" or "a coolant path 3C—5-R". As mentioned above, a coolant circulation pipe 3C, in the form of hollow cylinder (pipe), may herein be denoted as "micro channel," as shown in FIGS. 11 to 14.

Figure 12:
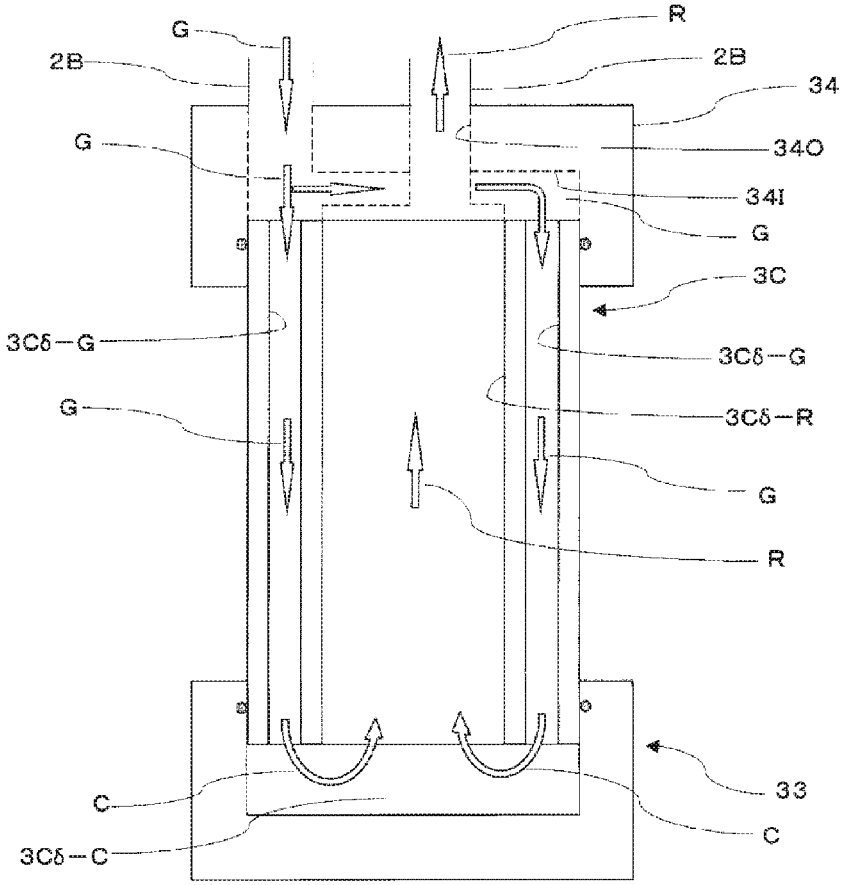
FIG. 12 is a front cross-sectional view showing the coolant circulation pipe, a plugging member and a connecting member according to the third embodiment.

In FIG. 12, a bottom socket 33 (plugging member) is brazed on the bottom of a first coolant circulation pipe 3C (micro channel) (underground end: lower portion in FIG. 12). This connection, however, may be achieved by a non-brazing method.

As mentioned above with reference to FIG. 11, a plurality of micro-coolant passages 3Cδ-G formed in a region radially outwardly located in the first coolant circulation pipe 3C in FIG. 12 correspond to a coolant supply side, and a coolant path 3Cδ-R formed in a region radially inwardly located in the first coolant circulation pipe 3C correspond to a coolant return side that returns to the coolant apparatus 10 (FIG. 1).

In FIG. 12, a micro-coolant passages 3Cδ-G in a radially outwardly located region and a coolant path 3Cδ-R in a radially inwardly located region are communicated by the bottom socket 33. Accordingly, the system according to the third embodiment, as in the first embodiment, also includes one first coolant circulation pipe 3C (micro channel), composed of a coolant supply side and a coolant return side.

In FIG. 12, the bottom socket 33 is provided with a communicating portion 3Cδ-C for communicating a micro-coolant passages 3Cδ-G on a coolant supply side and a coolant path 3Cδ-R on a coolant return side.

The liquid-phase carbon dioxide (secondary coolant) supplied from the coolant supply side flows in a plurality of micro-coolant passages 3Cδ-G on a coolant supply side (arrow G) to pass through the communicating portion 3Cδ-C in the bottom socket 33 (arrow C), the coolant paths 3Cδ-R on the coolant return side (arrow R) and return to the coolant apparatus 10 (FIG. 1).

The top socket 34 (connecting member) is brazed on the ground side of the first coolant circulation pipe 3C (micro channel) (upper portion in FIG. 12). However, as the bottom socket 33, this connection may be achieved by a non-brazing method.

In FIG. 12, a micro-coolant passages 3Cδ-G on a coolant supply side of the first coolant circulation pipe 3C is connected with a coolant supply side (coolant circulation pipe 2B on the left side in FIG. 12) of a coolant circulation pipe 2B with a circular cross-section (second coolant circulation pipe) through a coolant supply path 34I, in the top socket 34. On the other hand, a coolant path 3Cδ-R on a coolant return side of the first coolant circulation pipe 3C is connected with a coolant return side (coolant circulation pipe 2B on the right side in FIG. 12) of the coolant circulation pipe 2B with a circular cross-section (second coolant circulation pipe) through a coolant supply path 340 in the top socket 34.

The supply side and the return side of the coolant circulation pipes 2B with a circular cross-section are connected with a coolant supply side and a coolant return side (cooling line) of the coolant apparatus 10 (FIG. 1) of liquid-phase carbon dioxide, respectively.

According to the third embodiment being explained in reference with FIGS. 11 and 12, a coolant supply path in the first coolant circulation pipe 3C corresponds to a plurality of micro-coolant passages 3Cδ-G which are formed in a radially outwardly located region, and all the micro-coolant passages 3Cδ-G formed in the first coolant circulation pipe 3C can be used (applied) as a coolant supply path to cool the ground efficiently.

On the other hand, when a coolant having cooled the ground and having absorbed underground heat returns to the coolant apparatus 10 (FIG. 1), since said coolant flows in the radially inwardly located coolant path 3Cδ-R with a relatively large diameter, a ratio of flow area relative to flow rate relating to the radially inwardly located coolant path is smaller than the coolant supply path 3Cδ-G, and therefore, it is a low degree of possibility that a heat of the coolant flowing in the return path is transmitted to the coolant flowing in the micro-coolant passages 3Cδ-G.

Figure 13:
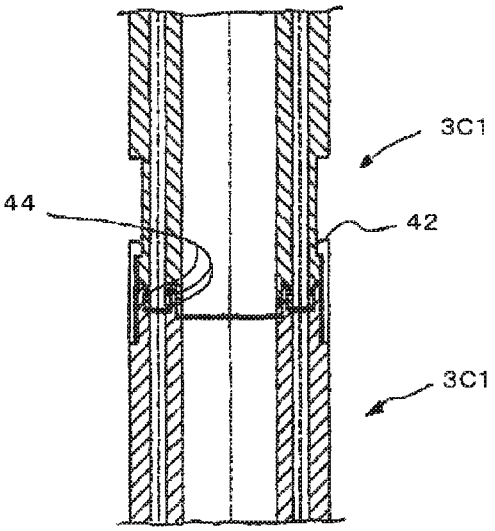
FIG. 13 is a fragmentary cross-sectional view showing one example of constructions of a joint member of the coolant circulation pipe.

FIG. 13 shows one example of first coolant circulation pipes used in the third embodiment, and both ends of a first coolant circulation pipe 3C1 shown in FIG. 13 are complementary in shape to other ends. When the first coolant circulation pipes 3C1 shown in FIG. 13 are connected, ends having complementary shapes are engaged with each other to be fixed by a pipe fixing member 42.

In FIG. 13, numeral 44 refers to a seal member for preventing leakage of a coolant (e.g., O-ring).

However, the connection of the first coolant circulation pipes used in the third embodiment is not restricted to the embodiment shown in FIG. 13.

Figure 14:
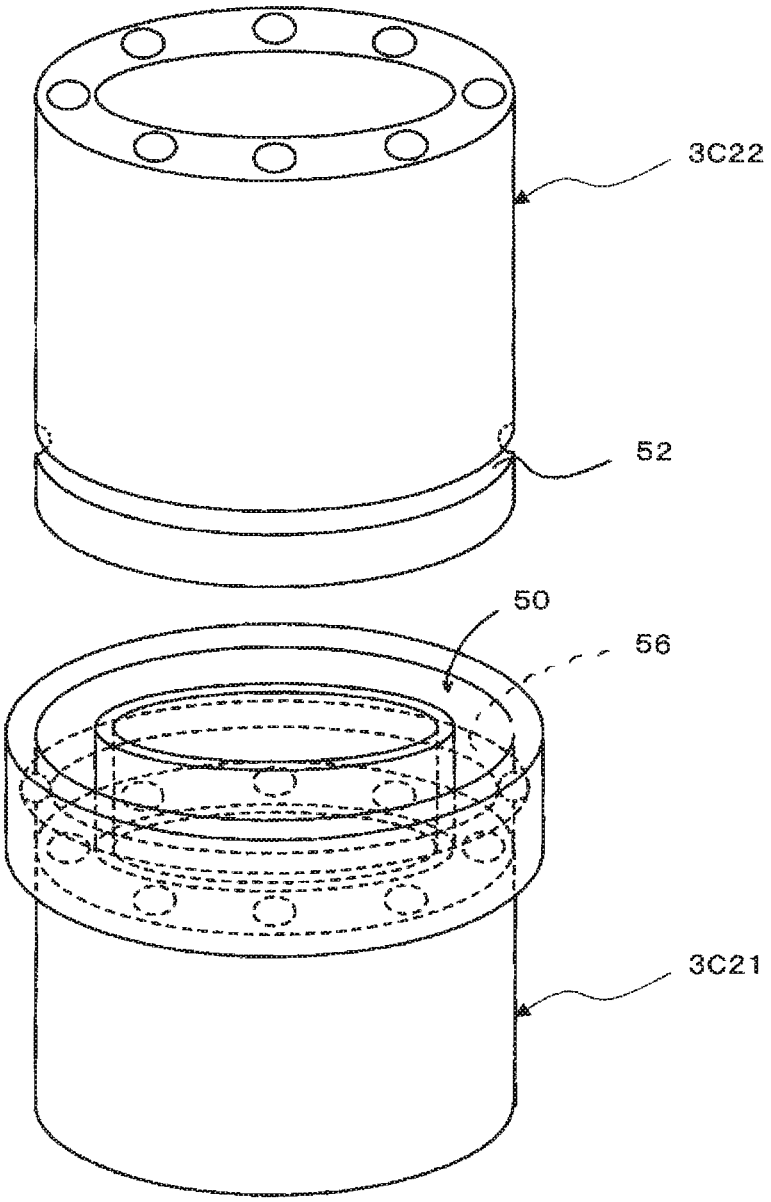
FIG. 14 is a perspective view showing constructions of another joint member of the coolant circulation pipes according to the third embodiment not shown in FIG. 12.

As shown in FIG. 14, an opening 50 of an upper end of one first coolant circulation pipe 3C21 (coolant circulation pipe 3C2 in lower portion in FIG. 14) can be constructed to receive a lower end of the other first coolant circulation pipe 3C22 (coolant circulation pipe 3C2 in upper portion in FIG. 14) for connection.

In order to prevent leakage of a coolant (carbon dioxide) from a connected portion, as shown in FIG. 14, a concave 52 (groove) extending circumferentially is formed on the outer peripheral surface of the upper first coolant circulation pipe 3C22, and a convex 56 made of sealing material (or O-ring) is formed in an opening 50 of a lower first coolant circulation pipe 3C21. When the first coolant circulation pipes 3C21, 3C22 are connected with each other, the convex 56 (sealing material) is engaged with the concave 50 to prevent leakage of a coolant (carbon dioxide) from a connected portion of the first coolant circulation pipes 3C21, 3C22.

Other constructions and effects in the third embodiment shown in FIGS. 11 to 14 are the same as in the embodiment shown in FIGS. 1 to 10.

Although the invention has been described through its specific form, it is to be understood that the described embodiment is only illustrative and is not intended to limit the scope of the invention.

In the embodiment shown herein, a borehole for inserting a freeze pipe is drilled using a casing drilling unit, but a borehole may be drilled by other methods (e.g., muddy water drilling method).

In the embodiments shown herein, a region extending vertically in the ground is frozen. However, in the present invention, a region horizontally extending in the ground and a region extending aslant from the vertical direction in the ground can be frozen.

In the embodiments shown herein, a region in the ground extending vertically downwardly from the ground is frozen. However, in the present invention, a region in the ground extending vertically upwardly can be frozen.

EXPLANATION OF LETTERS AND NUMERALS

1 . . . Freeze pipe (casing)
2 . . . Coolant circulation pipe
2A, 3C, 3C1, 3C21, 3C22 . . . First coolant circulation pipe (micro channel)
2Aδ-G, 2Aδ-R, 3Cδ-G . . . Micro-coolant passage of first coolant circulation pipe
2B . . . Second coolant circulation pipe (coolant circulation pipe with circular cross-section)
3, 3A, 3B, 33 . . . Plugging member (bottom socket)
4, 4A, 4B, 4C, 34 . . . Connecting member (top socket)
5 . . . Heat transfer fluid
6 . . . Insulator
7 . . . Packer
8 . . . Spacer
8H, 8M . . . Opening of spacer
9 . . . Micro channel rolling machine
10 . . . Coolant apparatus
10A . . . Liquefier
10B . . . Condenser
10C . . . Cooling tower
11 . . . Coolant circulation pump
100 . . . refrigerator
100A . . . Evaporator
100B . . . Condenser
100C . . . Cooling tower
101 . . . Freeze pipe
102 . . . Coolant circulation pump

The invention claimed is:

1. An artificial ground freezing system for freezing a ground around a coolant circulation pipe by circulating a low-temperature coolant in the coolant circulation pipe, wherein the coolant circulating in the coolant circulation pipe is carbon dioxide, wherein the artificial ground freezing system comprises a coolant apparatus which cools and supplies the low-temperature coolant to the coolant circulation pipe, wherein the coolant circulation pipe comprises a first coolant circulation pipe and a plugging member connecting to a tip portion of the first coolant circulation pipe, wherein the first coolant circulation pipe is a micro channel structure having a plurality of micro-coolant passages formed inside thereof, the micro channel structure having thermal properties of cold energy diffusion and hot energy absorption depending on coolant contacting area; a length of which channel corresponds to a vertical depth of a ground to be frozen, wherein the plurality of micro-coolant passages being formed in one of the first coolant circulation pipe constructs a coolant supply side and a coolant return side, and wherein a coolant flow path is constructed in which a coolant flows in the coolant supply side, the plugging member, and then the coolant return side.

2. The artificial ground freezing system according to claim 1, further comprising a freeze pipe being buried in order to freeze the ground to be frozen and formed underground, wherein the coolant circulation pipe is provided inside of the freeze pipe.

3. The artificial ground freezing system according to claim 1, wherein an end on the coolant supply side of the first coolant circulation pipe is connected with a connecting member which divides the plurality of micro-coolant passages of the first coolant circulation pipe into the coolant supply side and the coolant return side, and wherein the coolant supply side and the coolant return side of the plurality of micro-coolant passages of the first coolant circulation pipe are connected with second coolant circulation pipes through the connecting member.

4. The artificial ground freezing system according to claim 2, wherein an end on the coolant supply side of the first coolant circulation pipe is connected with a connecting member which divides the plurality of micro-coolant passages of the first coolant circulation pipe into the coolant supply side and the coolant return side, and wherein the coolant supply side and the coolant return side of the plurality of micro-coolant passages of the first coolant circulation pipe are connected with second coolant circulation pipes through the connecting member.

5. The artificial ground freezing system according to claim 3, wherein the connecting member is provided in the ground.

6. The artificial ground freezing system according to claim 4, wherein the connecting member is provided in the ground.

7. The artificial ground freezing system according to claim 3, wherein the connecting member is provided at a region being closer to the coolant supply side than the ground.

8. The artificial ground freezing system according to claim 4, wherein the connecting member is provided at a region being closer to the coolant supply side than the ground.

9. The artificial ground freezing system according to claim 1, wherein a heat transfer fluid is filled in a region corresponding to the ground to be frozen, and an insulator is provided in a region corresponding to the ground not to be frozen.

10. The artificial ground freezing system according to claim 2, wherein a heat transfer fluid is filled in a region corresponding to the ground to be frozen, and an insulator is provided in a region corresponding to the ground not to be frozen.

11. The artificial ground freezing system according to claim 3, wherein a heat transfer fluid is filled in a region corresponding to the ground to be frozen, and an insulator is provided in a region corresponding to the ground not to be frozen.

12. The artificial ground freezing system according to claim 4, wherein a heat transfer fluid is filled in a region corresponding to the ground to be frozen, and an insulator is provided in a region corresponding to the ground not to be frozen.

13. The artificial ground freezing system according to claim 5, wherein a heat transfer fluid is filled in a region corresponding to the ground to be frozen, and an insulator is provided in a region corresponding to the ground not to be frozen.

14. The artificial ground freezing system according to claim 6, wherein a heat transfer fluid is filled in a region corresponding to the ground to be frozen, and an insulator is provided in a region corresponding to the ground not to be frozen.

15. The artificial ground freezing system according to claim 7, wherein a heat transfer fluid is filled in a region corresponding to the ground to be frozen, and an insulator is provided in a region corresponding to the ground not to be frozen.

16. The artificial ground freezing system according to claim 8, wherein a heat transfer fluid is filled in a region corresponding to the ground to be frozen, and an insulator is provided in a region corresponding to the ground not to be frozen.

17. An artificial ground freezing method for freezing a ground around a coolant circulation pipe by circulating a low-temperature coolant in the coolant circulation pipe by an artificial ground freezing system which cools the coolant and supplies it to circulation pipe by means of a coolant apparatus, wherein the coolant circulating in the coolant circulation pipe is carbon dioxide, wherein the artificial ground freezing method comprising the steps of:

cooling the coolant by the coolant apparatus and supplying it to the coolant circulation pipe;

circulating the coolant in the coolant circulation pipe and returning to the coolant apparatus, and freezing ground to be frozen underground, wherein the coolant circulation pipe comprises a first coolant circulation pipe and a plugging member connecting to a tip portion of the first coolant circulation pipe, wherein the first coolant circulation pipe is a micro channel structure having a plurality of micro-coolant passages formed inside thereof, the micro channel structure having thermal properties of cold energy diffusion and hot energy absorption depending on coolant contacting area; a length of which channel corresponds to a vertical depth of the ground to be frozen, wherein the plurality of micro-coolant passages being formed in one of the first coolant circulation pipe constructs a coolant supply side and a coolant return side, and wherein the step of circulating the coolant in the coolant circulation pipe and returning to the coolant apparatus comprises a step of:

flowing the coolant in the coolant supply side of the first coolant circulation pipe; in a coolant flow path of the plugging member, and then, in the coolant return side of the first coolant circulation pipe.

18. The artificial ground freezing method according to claim 17, wherein said artificial ground freezing system further comprises a freeze pipe being buried in order to freeze the ground to be frozen and formed underground, wherein the coolant circulation pipe is provided inside of the freeze pipe.

19. The artificial ground freezing method according to claim 17, wherein an end on the coolant supply side of the first coolant circulation pipe is connected with a connecting member, and carbon dioxide flowing on the coolant supply side of the plurality of micro-coolant passages of the first coolant circulation pipe and carbon dioxide flowing on the coolant return side flow on a coolant supply side and a coolant return side of second coolant circulation pipes, respectively, through the connecting member.

20. The artificial ground freezing method according to claim 18, wherein an end on the coolant supply side of the first coolant circulation pipe is connected with a connecting member, and carbon dioxide flowing on the coolant supply side of the plurality of micro-coolant passages of the first coolant circulation pipe and carbon dioxide flowing on the coolant return side flow on a coolant supply side and a coolant return side of second coolant circulation pipes, respectively, through the connecting member.

21. The artificial ground freezing method according to claim 19, wherein the connecting member is provided in the ground.

22. The artificial ground freezing method according to claim 20, wherein the connecting member is provided in the ground.

23. The artificial ground freezing method according to claim 19, wherein the connecting member is provided in a region being closer to the coolant supply side than the ground.

24. The artificial ground freezing method according to claim 20, wherein the connecting member is provided in a region being closer to the coolant supply side than the ground.

25. The artificial ground freezing method according to claim 17, comprising:

a step for filling a heat transfer fluid in a region corresponding to the ground to be frozen; and a step for providing an insulator in a region of the ground not to be frozen.

26. The artificial ground freezing method according to claim 18, comprising:

a step for filling a heat transfer fluid in a region corresponding to the ground to be frozen; and a step for providing an insulator in a region of the ground not to be frozen.

27. The artificial ground freezing method according to claim 19, comprising:

a step for filling a heat transfer fluid in a region corresponding to the ground to be frozen; and a step for providing an insulator in a region of the ground not to be frozen.

28. The artificial ground freezing method according to claim 20, comprising:

a step for filling a heat transfer fluid in a region corresponding to the ground to be frozen; and a step for providing an insulator in a region of the ground not to be frozen.

29. The artificial ground freezing method according to claim 21, comprising:

a step for filling a heat transfer fluid in a region corresponding to the ground to be frozen; and a step for providing an insulator in a region of the ground not to be frozen.

30. The artificial ground freezing method according to claim 22, comprising:

a step for filling a heat transfer fluid in a region corresponding to the ground to be frozen; and a step for providing an insulator in a region of the ground not to be frozen.

31. The artificial ground freezing method according to claim 23, comprising:

a step for filling a heat transfer fluid in a region corresponding to the ground to be frozen; and a step for providing an insulator in a region of the ground not to be frozen.

32. The artificial ground freezing method according to claim 24, comprising:

a step for filling a heat transfer fluid in a region corresponding to the ground to be frozen; and a step for providing an insulator in a region of the ground not to be frozen.

* * * * *